US011175002B2

(12) United States Patent
Albrechtsen

(10) Patent No.: US 11,175,002 B2
(45) Date of Patent: Nov. 16, 2021

(54) LED DRIVER BOX

(71) Applicant: Nulite Lighting, Denver, CO (US)

(72) Inventor: Haley Albrechtsen, Louisville, CO (US)

(73) Assignee: Nulite Lighting, Denver, CO (US)

( * ) Notice: Subject to any disclaimer, the term of this patent is extended or adjusted under 35 U.S.C. 154(b) by 0 days.

(21) Appl. No.: 16/011,629

(22) Filed: Jun. 18, 2018

(65) Prior Publication Data

US 2019/0104585 A1 Apr. 4, 2019

Related U.S. Application Data

(60) Provisional application No. 62/523,769, filed on Jun. 23, 2017.

(51) Int. Cl.

| | |
|---|---|
| ***F21S 8/02*** | (2006.01) |
| ***F21V 21/04*** | (2006.01) |
| ***H05B 45/00*** | (2020.01) |
| ***F21V 23/02*** | (2006.01) |
| ***F21V 21/03*** | (2006.01) |
| ***F21V 23/00*** | (2015.01) |
| *H05B 45/357* | (2020.01) |

(52) U.S. Cl.

CPC ..... *F21S 8/026* (2013.01); *F21V 21/03* (2013.01); *F21V 21/043* (2013.01); *F21V 23/007* (2013.01); *F21V 23/023* (2013.01); *H05B 45/00* (2020.01); *H05B 45/357* (2020.01)

(58) Field of Classification Search

CPC .... F21V 23/023; F21V 23/007; F21V 21/043; F21V 21/03; H05B 45/00; H05B 45/37

See application file for complete search history.

(56) References Cited

U.S. PATENT DOCUMENTS

| | | | | |
|---|---|---|---|---|
| 6,095,671 | A * | 8/2000 | Hutain | F21V 29/507 362/373 |
| 6,632,006 | B1 * | 10/2003 | Rippel | F21S 8/02 362/147 |
| 8,684,570 | B1 * | 4/2014 | Fuchs | F21V 23/009 362/418 |
| 9,557,021 | B2 * | 1/2017 | Madden | F21V 23/008 |
| 9,726,354 | B1 * | 8/2017 | Delano | F21V 21/14 |
| 2010/0277905 | A1 * | 11/2010 | Janik | F21V 29/763 362/235 |
| 2016/0312987 | A1 * | 10/2016 | Danesh | F21S 8/026 |
| 2016/0366738 | A1 * | 12/2016 | Boulanger | F21V 17/14 |
| 2018/0202634 | A1 * | 7/2018 | Farzan | F21V 23/009 |

FOREIGN PATENT DOCUMENTS

WO WO-2012135640 A1 * 10/2012 ..... H05B 45/50

* cited by examiner

*Primary Examiner* — Leah Simone MacChiarolo
(74) *Attorney, Agent, or Firm* — Starfort IP; John T Henri

(57) ABSTRACT

A LED driver boxes for luminaires or LED lighting systems installed in applications where the building is pre-existing, and luminaires are retro-fitted to the space with great advantages in convenience is described. Driver box applications where luminaires are installed in a new construction where the ceiling has yet to be installed/built is easy. Driver boxes may be used where the ceiling is already built and for ease of installation and maintenance, the contractor may want to choose an option where the luminaire has easily accessible electronic components. The LED Driver Boxes provide a safe, clean, and rigid method to maintain the electronics by separating line voltage from DC voltage and electronics.

10 Claims, 47 Drawing Sheets

LED DRIVER BOX

BACKGROUND

LED (light emitting diode) lighting has begun to be widely used for various lighting purposes due to its high energy efficiency, cost, and decreased size relative to other lighting sources.

The LED light sources have decreased size relative to other light sources to such an extent that the electronic components required to run the light sources are the constraining factors in fixture design. By removing the electronics from the fixture, the designer is granted freedom to make smaller fixtures. The issues presented are what to do with the electronics, how they are installed, and how they are maintained.

With the electronics now being remote, there needs to be a means for them to be maintained and accessed once they've been installed. Additionally, due to the variability in ceiling type, there must be a means to have the remote electronics installed in any ceiling type.

Inevitably electronics meet a point in service life where they retire or fail and need to be replaced, or the user requests a change and they need to be accessed to deploy that change. Luminaires or LED lighting systems may be installed in applications where the building is pre-existing, and they are retro-fitted to the space. Other times, luminaires are installed in a new construction application where the ceiling has yet to be installed/built. Other times the ceiling is already built and for ease of installation and maintenance later in life, the contractor may want to choose an option where the luminaire has easily accessible electronic components. In order to address the aforesaid problems and provide a safe, clean, and rigid method to maintain the electronics new solution is needed.

SUMMARY OF INVENTION

A LED driver device with a container with two compartments, isolated from each other with one compartment bearing components to receive and convey AC power to the second compartment and a second compartment bearing components to output DC power and control signals to a LED engine and adjustable fasteners to mount the device for deployment.

A LED driver device with a container with two compartments, isolated from each other with one compartment bearing components to receive and convey AC power to the second compartment and a second compartment bearing components to output DC power and control signals to a LED engine and adjustable fasteners to mount the device for deployment with the second compartment bearing a detachable complimentary housing bearing electrical components like battery packs, LED drivers, sensor control units, or other remote electronics for DC power supply and control signals from the device.

A LED driver device with a container with two compartments, isolated from each other with one compartment bearing components to receive and convey AC power to the second compartment and a second compartment bearing components to output DC power and control signals to a LED engine and adjustable fasteners to mount the device for deployment where the detachable complimentary housing component is a tray or draw like sliding compartment. The detachable complimentary housing component may have a complimentary shape to detach and attach from the second compartment selected from cylindrical, cubical and conical shapes for secure and facile engagement. The detachable complimentary housing component is an adjacent overlapping folding or hinged compartment.

The detachable tray may be accessed with no interference/disruption to the luminaire.

The container with 2 compartments electrically isolated from each other, can be installed in multiple ceiling types including grid, drywall, or other like types.

The container has the versatility to be installed at the new construction or/and retrofit space applications.

The wall separating the compartments of the driver is adjustable.

DETAILED DESCRIPTION

The flange remote box (FRB) or LED driver device is a device power supply unit, or remote electronics system, or integrated electronics that converts line voltage to low voltage in order to run the LEDs. The FRB may have electronics that can interpret control signals such as to dim LEDs. Because LED lighting may be used to replace older lighting means, the flange remote box coupled with LED components can be used to replace older lighting systems by flexible and minimally invasive means to building surfaces.

The flange remote box system isolates the low voltage LED lighting components from more dangerous line voltage so that a user can unplug, replace or service a system component safely. The ability to bring the power source into direct proximity of a fixture and offer safe separation of high and low voltage circuits, avoids the need for an electrician. This locality of the electronics with respect to the fixture eliminates the requirement for an allocated electrical room/closet. This makes it easier for the contractor or any person to service the electrical components after installation. It makes the process simple, clean, safe, and intuitive. The flange remote box makes it possible to access various parts of LED fixtures such as the driver(s) and LED engine etc., independently of each other. This FRB bears a "driver tray" and has the capability to be installed at any point during the construction phase which may be before or after the ceiling is installed. The flange remote box offers extraordinary ease in electrical component accessibility allowing electrical components to be 1) maintained/accessed without disengaging the luminaires mounting, 2) without an electrician, and 3) have the electrical components in the same vicinity as the luminaire, and not at a remote electrical closet.

In one embodiment, the flange remote box has two compartments isolated from each other by a partition, one compartment bearing components to an AC input power line [9] and the other compartment bearing components to output DC power and control signals to a lighting system [6]. Each component in the enclosure is composed of a pre-treated steel material such as galvanized or galvaneal steel for rigidity, corrosion resistant, and is of an appropriate thickness for the application, meaning that insulated copper wire can pass over the material without requiring a jacket sleeving or other component like a bushing or the like. The compartment bearing the outputs to DC power are mounted on a detachable member [12]. The detachable member is a tray that can be slid in and out of the compartment. In variations of the embodiment there is no isolation between the high and low voltage compartments directly, but additional brackets or other like means could be used to completely isolate the high and low voltage compartments.

In variations of the embodiment, the detachable component may fit in like a tray form, a piston in a cylinder, or any other form with a complimentary surface for engagement, that can be easily detached from the housing of the flange remote box. re 8 shows one embodiment where the tray [12] is making a vertical translation to provide the electrical connection between the LED driving components and the building power. The tray uses latches [22], or like securing means, to be securely attached. In other embodiments, the tray needs no fastener to be securely connected and function in the remote box. In one variation of the embodiment, shown in FIGS. 2 & 24, the tray uses a hook feature [40] and an overlay of materials, along with a screw, to secure the driver tray into the housing. FIG. 24 shows the utilization of the hook as another means to hang the driver tray at the box level to provide ease to making building power connections to the box. In another variation of the embodiment, shown in FIG. 34-47, the tray uses a captive thumb screw and captive nut to make a secure connection between the driver tray and the housing, which can be seen in FIGS. 34 & 38 respectively.

The driver tray allows the main structure of the box to remain electrically isolated, intact to the ceiling structure, and the electronics to be easily and quickly disengaged by anyone. Incorporating the driver tray design and utilizing brackets to isolate the building connection wires, eliminates the need for an electrician, allows the electronics to be worked on at the ceiling level or ground level, and utilizes a clean, efficient, simple, plug-and-play system. The driver tray has a versatile whip that is used to provide the electrical current from one are to another. The whip is also referred as a wiring harness. The embodiments utilize two different types of whips. One whip is permanently fixed to the LED components and is referred to as the driver tray whip or wiring harness. The other whip in the embodiments is the contractor whip or exit whip, that contains push nuts, lever nuts, and other like components for easy building connection. The interaction of the whips engagement with one another is the translation and electrical connection for current to pass from the building to the LED driving components, to the light engines or LEDs at the luminaire level. The dis-engagement of the whips disconnects the path for the current to flow, meaning that no current is supplied to the LED components on the driver tray. The whips are composed of various wire types for the different embodiments, for example the FRB HAS 18GA solid copper wire, rated at 600V and the SRB utilizes 18GA stranded copper wire allowing for easier flexibility and maneuverability in the whip. Each whip is terminated by a rectangular power connector. In the FRB embodiment both whips are terminated by panel mount connectors. In other embodiments, the contractor whips are terminated by a panel mount connector, and the driver tray is terminated by a standard power connectors. In all embodiments, the engagement between the driver tray connector and the contractor connector is retained by a locking mechanism inherent to the connectors themselves. Where one style of connector uses the TE Mate-N-Lok and another type of connector uses the Molex locking ramp. The adding locking features of the connectors provide another added level of secure connection and safety from electrical shock risk.

In FIGS. 8 & 9, one embodiment of the flange remote box, shows housing [2], driver tray [12], fixture mounting point [7], wiring compartment divider bracket [21], the panel mount wiring harnesses for contractors [10] and for the LED drivers [11]. The driver tray is a dynamic mechanism that retains the electrical components. Those electrical components may include battery packs, LED drivers, sensor control units, or other remote electronics. The assembly is designed in such a way that it may be installed before or after the ceiling has been constructed and installed in the field. In this embodiment, the driver tray has a U-shaped cut out [32] shown in FIGS. 6 & 18 that allows for the tray to be removed and pulled away from the fixtures mounting point and hardware without interfering with the fixture.

The FRB typical retrofit installation is a simple 2-screw [8], cap nut [27], level lug [3] design that is unique for the application shown in FIGS. 2 & 6. It provides extreme ease for the initial housing installation. In this example of the embodiment, the person installing the housing starts by cutting a circular hole at 5" in diameter in the sheet rock ceiling, then brings the building wires down from the ceiling and makes an electrical connection to the box in the isolated high voltage compartment [9] at the top of the housing, and then inserts the box through the hole opening shown in FIGS. 8 & 9. The hole opening is minimized in diameter by the housing; in this embodiment the hole opening is a 5" diameter hole. The flange [5] on the housing shown in FIGS. 6 & 13 prevents the box from fully plunging into the ceiling space. The two bolts [8[ have exposed screw heads on the flange [5] that the installer drives with a Philips Head tool like a drill to clamp the housing to the ceiling, shown in FIGS. 6 & 15. The level lugs installation to the box is shown in FIGS. 14 and 15. There are cut outs [28] in the flange [5] so that the level lug assembly may be installed as a separate process. There is an angle on the level lug [3] at the top end to engage the bolt [8] and a tapped hole where the bolt first enters the level lug. This engagement forces the level lugs to spread outward from the housing from the position seen in FIG. 8 to the position seen in FIG. 2. By continuing to drive the bolt, the level lugs move closer to the flange [5] until they are engaged to the ceiling structure as shown in FIG. 3. At the top of the bolt, the acorn nut [27] captures the dri-lock tipped bolt, screw, Nyloc nut, or other like captive fastener, at the housing flange [29] so the level lug has a restricted amount of travel and will not be dis-assembled when driven by a drill, shown in FIG. 3. In another embodiment the amount of travel could be unlimited. FIGS. 2-3 shows an example of the embodiment where the flange driver box has been fully installed and secured to the ceiling by driving the level lugs from the housing flange [29] down to the ceiling structure [26]. In this embodiment, the housing is installed in sheet rock, or other like ceiling structures, where the thickness are of three different types. A possible range of 1/16 to 10 inches. A likely range of 3/8 to 5/4 inches. A preferred range 3/8 to 5/8 inches.

The other installation method for this embodiment would be done in a "new construction" application, where the ceiling has not been built yet and only joists or the t-grid is laid out in the space; additionally, if the user needs to be able to access the LED drivers but cannot get into the ceiling after it has been roughed in. This is shown in FIGS. 1, 4, 5, and done by having the mounting bracket [1] installed to the driver box housing [2] by screws or other like hardware. The contractor may install the sheet rock rails [20] or grid hanger bars [14] on the mounting bracket or may install the mounting bracket to the rails in FIGS. 4 and 5 respectively. In this embodiment, the rails are adjustable anywhere from 12" to 24" and have their own details to be easily installed to structure or grid. The installation of the rails is shown in FIGS. 20 and 21. Due to different ceiling thicknesses ranges, the grid hanger bars have multiple locations for installation to the mounting bracket [1]. The ceiling thickness could be the possible range of 1/16 to 10 inches, a likely range 3/8 to 5/4 inches, or the preferred 3/8 to 5/8 inches. If the rails or bars are first installed to the mounting bracket, the contractor installs them to whatever ceiling type they have; this may be structure ceiling (i.e. wood/metal joists) or a grid ceiling. The rails have their own details to be easily installed to structure or grid.

At this point the fixtures may be installed or the driver trays may be installed. This is an added point of flexibility during the installation phase. The high voltage compartment is completely isolated and inaccessible once the housing is installed. The high voltage compartment becomes accessible for maintenance when it is necessary to manage the wired connections in the junction area. In one embodiment the LED driver device must be uninstalled from the ceiling to access this area. In other embodiments, this area may be accessed by removing a bracket while the enclosure remains installed. The drivers make their electrical connection to the building once the driver tray is installed. This connection happens over a quick plug [6] connection integrated in the design of the housing and driver tray [12]. This connection interaction [68] can be seen more explicitly in FIGS. 8-10. By utilizing a quick disconnect method between the high voltage compartment and the electronics, the need for a licensed electrician to handle maintenance on the fixtures is optional.

In the flange driver box embodiment, fixtures are installed to the flange remote box by a special mounting gripper [17 & 18] and aircraft cable [49] seen in FIG. 22. The aircraft cable [49] drops through the gripper [18], and the internal gripper threads screw onto a ¼-20" threaded rod [7] that is an inherent part of the remote flange box housing. Once the fixture is threaded to this rod, the fixture is "installed" and only height adjustments are required for the mechanical fixation. The driver tray may be installed after this fixture has been installed (or before). In either scenario, the driver tray slides around the threaded rod, and is then pressed upward. The quick connects engage, and the fixture is now electrically connected.

In other embodiments, the driver box may have other means for installation including an enclosing case, strap, or straps, welds, glues, cables and the like.

In one embodiment, the flange remote box is installed on drywall surface. In one embodiment, the flange remote box is installed before the drywall surface has been constructed. In another embodiment, the flange remote box is used for retrofit drywall installation. In all embodiments, the flange remote box may be accessed without lowering the fixture or run of fixtures.

In various embodiments, the drivers of the present invention are installed on different ceiling types including drywall and can be installed on different ceiling thicknesses ranges, being the earlier mentioned possible, likely, and preferred range. In one embodiment, where the flange remote box is installed in a drywall ceiling, the ceiling thickness could be a likely range of ⅜ to ⅝ inches. The flange remote box may also be installed in drywall ceilings with a larger ceiling thickness than 2", as this would be a customizable thickness for end users and be in the possible range of 1/16 to 10 inches.

In various embodiments, the drivers of the present invention are serviced at the fixture level, or at the ground level.

In various embodiments, the drivers of the present invention have the high voltage compartment completely isolated from the DC compartment. This isolation means the LEDs or light sources cannot accidentally be mis-wired, or damaged, by an electrician due to the crossing of high and low voltages. The high voltage compartment consists of the driver's AC voltage wires, terminated by wire push nuts or other like hardware. The low voltage output compartment consists of the LED or light source DC voltage wires terminated by lever nuts, different components than the AC voltage wires or tied to the driver(s) DC LED output wires. There are no bare high voltage wires in the low voltage compartment, keeping it isolated from a potential high voltage short or shock to the driver device enclosure. In the flange box embodiment, when the driver tray is dis-engaged there are no energized components in the low voltage compartment. The cavities in the two compartments of the driver box provide isolation or separation of components of high voltage or line voltage in one compartment from the fixtures DC voltage components in another compartment. Such a configuration provides for safe and convenient access to users and protection from contact with dangerous high voltage during installation, maintenance, uninstallation and like activities.

In this example of the embodiment, the contractor or electrician or certified installation person connects their building power, wiring and cabling run throughout the building, to the enclosure with conduit or other like means, and uses the contractor whip [10] terminated with push nuts and lever nuts to make the electrical connection. Shown in FIG. 11. When the enclosure wires are spliced in with the conduit brought in by the electrician, the enclosures power connection has been made with the building. This allows the current to flow, by the multiple wire conductors from the conduit to the contractor whip [10] in the enclosure and made a powered connection. In all embodiments, the building connection happens at a provided junction where push nuts and lever nuts are provided. The provided push nuts and lever nuts are connected to insulated 18GA copper wire. This provides ease for the contractors or installers because they are now only responsible for pushing in their building wire and no other hardware or components are necessary. In all embodiments, building connections are made at prepared wires terminated with push nuts and lever nuts. The consistency of this building connection across the different embodiments allows for repeatability without doubt. It also eliminates potential error for the contractor or installer to improperly wire and connect the LED driving components to the LED emitting elements. For example, the LED driver is pre-wired to the wiring harness [11] shown in FIGS. 7, 8, 10, 23, 25, 35, 37, which is engaged and disengaged at a plug junction. The other side of the plug junction has the wires terminated with push nuts and lever nuts. The contractor or installer only needs to worry about one connection for luminaire wiring. In some cases, the fixture can have multiple power zones and dimming zones, meaning different power circuits control the LED components. This is dependent on what building wires connect to the input sides of the driver, for AC and dimming control. The pre-wired and assembled driver trays mitigate the possibility for mis-wiring error to the LED drivers.

In one embodiment, the two compartments are adjacent to each other. In other embodiments, the compartments may be separated.

In various embodiments, the present invention utilizes a level lug system and bracket for dual ceiling installation applications.

In various embodiments, the drivers of the present invention feature an ease of component replacement and safe, quick, and easy electrical component maintenance. Maintenance negates the need for fixture interference and the row/fixture can remain untouched for maintenance.

LED drivers may need to be mounted in a ventilated space. Access to the driver needs to be provided for general maintenance purposes. The IP (ingress protection) rating of the driver needs to be considered before finalizing the mounting location of the driver (only those drivers designed for outdoor environments can be located outdoors). The distance between the driver and the light source needs to be taken into consideration in order to prevent voltage drop, which results in reduced output of the LEDs.

DESCRIPTION OF FIGURES

Referring now in more detail to the drawings, where numerals indicate aspects of the embodiment that maintain its functionality and elaborate on its installation versatility.

FIG. ONE: Is a perspective of the flange remote box with the new construction mounting bracket [1], where FIG. 1 is used in embodiments with an accessible ceiling FIG. TWO: Is a perspective of the flange remote box used in an embodiment for an inaccessible ceiling. In this embodiment, [3] is a mechanism that allows the engagement and installation of the flange remote box housing into the ceiling interface. By engaging the bolt, [8], that the level lug [3] is attached to, the level lug will travel the direction the bolt spins. This allows for multiple celling thicknesses to be compatible with this embodiment. A possible range of 1/16 to 10 inches, or a likely range of 3/8 to 5/4 inches, or a preferred range of 3/8 to 5/8 inches. The high voltage compartment is located under the access plate [4]. Various knockouts are located all around the high voltage compartment for building power connection.

FIG. THREE: Is a further perspective of the inaccessible ceiling application. Components [16-18] are used to close the flange box's electrical compartment to an open room. [16] is a decorative finish piece, that creates a complete enclosure of the flange driver box components. By removing [17] the canopy may be removed, by removing [18] the fixture may be uninstalled.

FIG. FOUR: Is a further perspective of a new construction application where the flange remote box is compatible with a grid ceiling of a preferred ceiling/tile thickness 3/8 to 5/8 inches. In this embodiment, the fixture's mounting point is from an all-thread bolt, [7]. The mounting bracket has various holes on its side to allow its wide range of grid ceiling installation variations. The grid hanger bars, [14], offer an example of what one set of hanger bars may look like after installation. In this embodiment, the hanger bars are attached to the mounting bracket by means of hardware, [15]. The mounting bracket may be tied back to some sort of structure in the ceiling interface by means of holes [13].

FIG. FIVE: Is a further perspective of a new construction application where the flange remote box is compatible with structured ceilings, various joist ceilings, or other like ceilings where drywall hanger bars, [20], are regarded. The drywall hanger bars offer an example of what one set may look like, and how they attach with the mounting bracket with associated hardware[19]. There is a flange ring [5], on the flange driver box housing that makes direct contact with the ceiling so there is no air gap.

Figure 6:
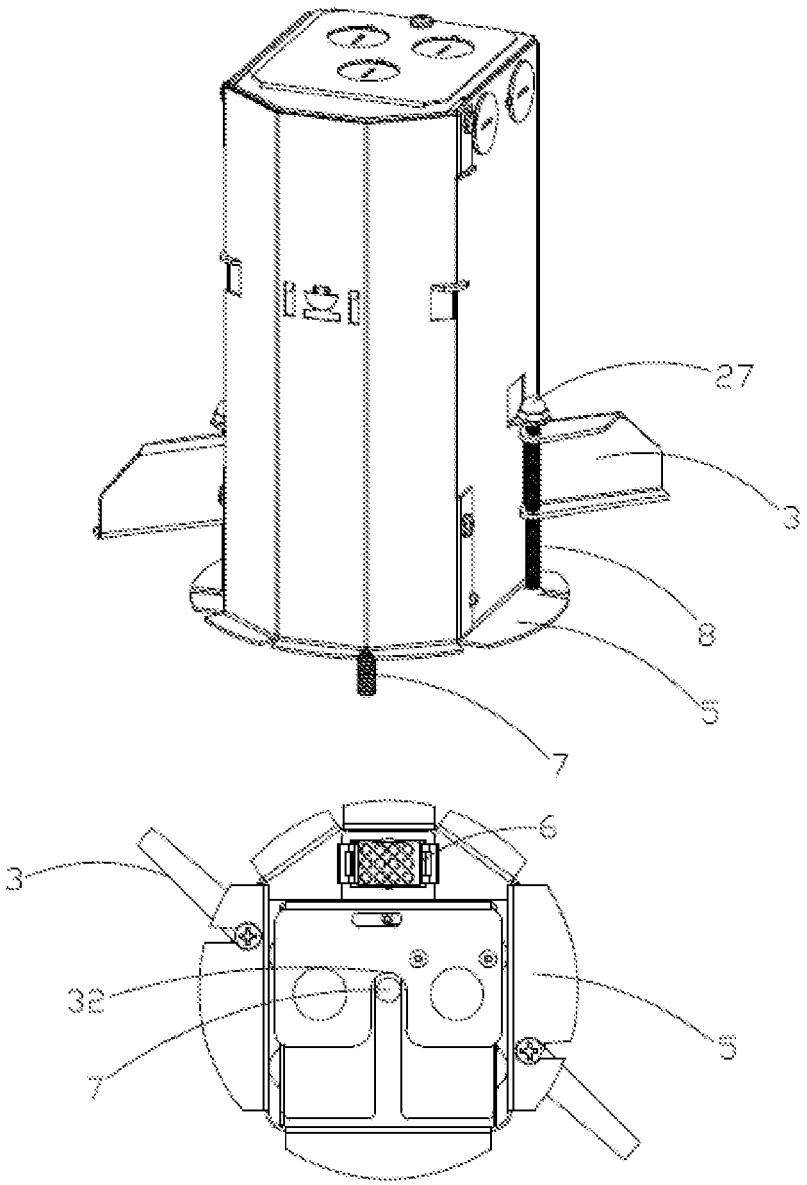

FIG. SIX: Is a further perspective of the interactive components to the flange driver box. There are two level lugs, [3], that allow for the installation in retro-fit scenarios. FIG. 6 shows the level lugs at full expansion. This allows for the greatest amount of surface area engagement with the ceiling. The bottom flange ring, [5], is a stop for a retro-fit application. In that embodiment, the housing would be inserted through a hole opening in the ceiling and would be stopped from further insertion by the flange ring at the bottom of the housing. The driver box has its luminaire mounting point at its center, [7]. The driver tray has its own whip to allow for full isolation between the high and low voltage compartments. The area around [6] is where the electrical connections between the two whips.

Figure 7:
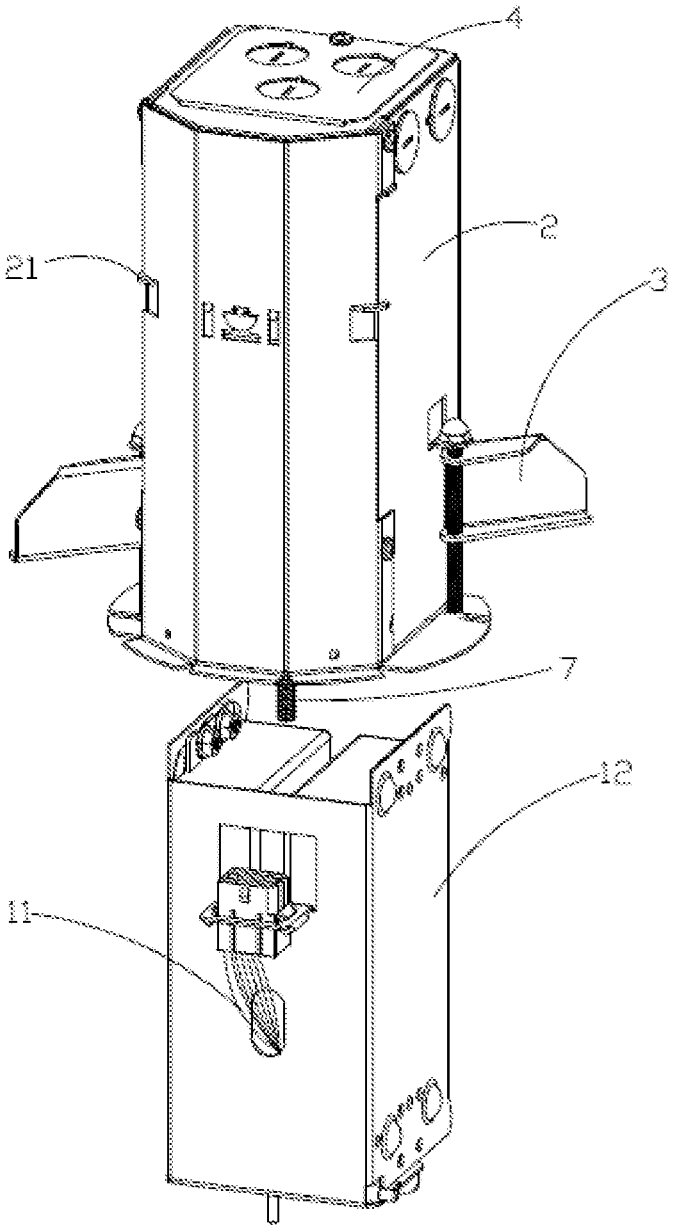

FIG. SEVEN: Is a further perspective of the engagement and dis-engagement of the driver tray [12]. The electronics are installed on the driver tray and wired up to a specified whip and plug 11, or other like means. FIG. 7 shows the exploded view of the driver tray and flange box housing. The tray, now containing the electronics, can be inserted vertically into the flange driver box body. Once the tray is inserted, the drivers, and wires are now inaccessible without removing the driver tray [12] or access plate [4].

FIG. EIGHT: is a further perspective of the exploded view of the engagement and dis-engagement of the driver tray, where the plug interface is detailed further [68]. The isolated high voltage compartment, [9], is only accessible through the access plate after the enclosure has been fully assembled. The contractor connects building wires inside the high voltage compartment to the wires coming out of the exit whip, [10]. The driver tray whip, [11], makes the electrical connection with the exit whip when the driver tray is inserted into the housing.

FIG. NINE: Is a further perspective of the exploded view with a cross sectional area cut out to show the longitudinal interaction between the driver tray [12] and the isolated building connection compartment [9]. The fact that the whips are panel mounted to different brackets allows for excess air gaps to be filled with material to eliminate the possibility for human interaction.

Figure 10:
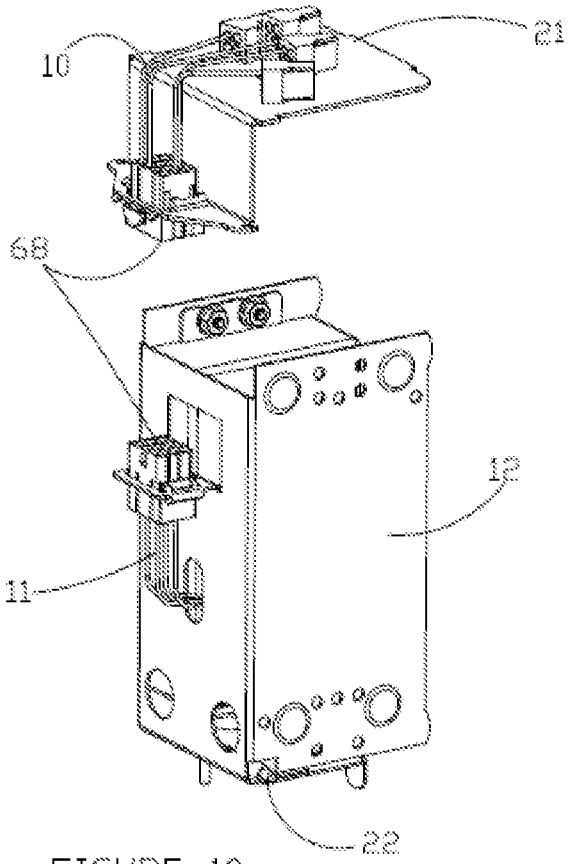

FIG. 10: Is a further perspective of just the driver tray and isolated building connection compartment. A safety spring latch [22] can be seen in the driver tray, that ensures stable electrical connection over the plugs, and safety in the driver trays securement to the driver box housing.

Figure 11:
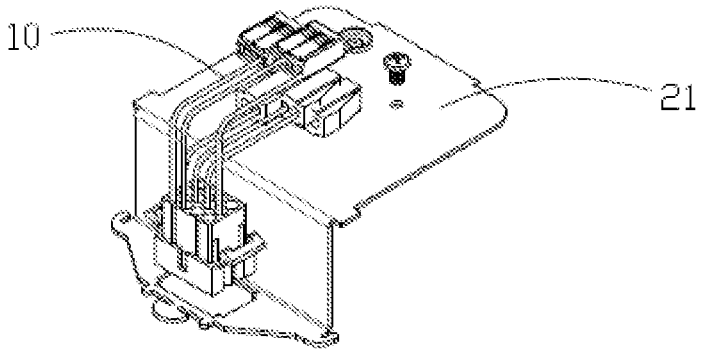

FIG. 11: Is an isolated view where the components that fix to the wiring compartment divider bracket [21] are exploded to better see their assembly to the bracket. There is a ground wiring connection made to the bracket itself by hardware. The contractor plug is fixed to the bracket by a panel mount cut out, so that it may not be un-installed or fall out of the bracket. The high voltage wires are terminated by push nuts, the low voltage wires are terminated by lever nuts.

Figure 12:
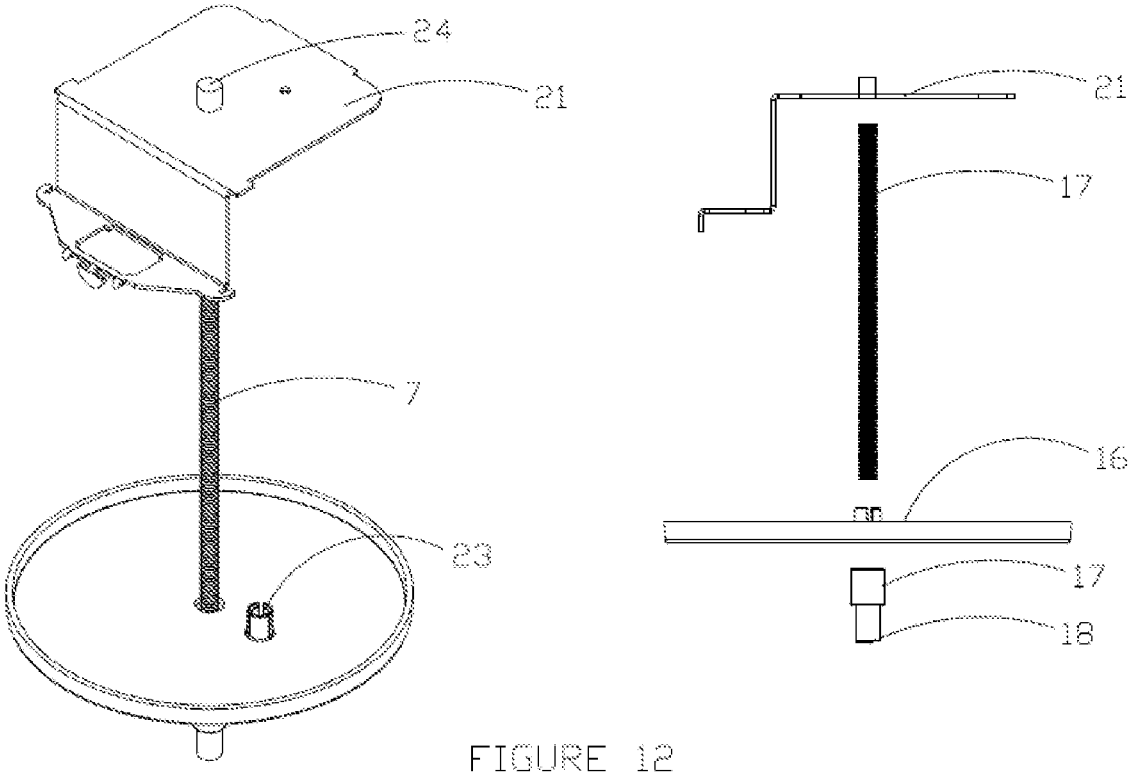

FIG. 12: Is an exploded perspective of the mounting hardware and how it is connected to the driver box and its associate components. The 1/4-20 threaded rod [7] is threaded into the 1/4-20 PEM standoff [24] where it is then permanently secured to the divider bracket [21]. The fixture mounts from the coupler [18]. The canopy can slide over the coupler [18] but once the slip ring is threaded onto the coupler [18] the canopy [16] can no longer pass over the coupler [18]. The fixture cable is strained by the built-in strain relief [23] in the canopy to keep the straight tautness of the cable that is visual appealing.

Figure 13:
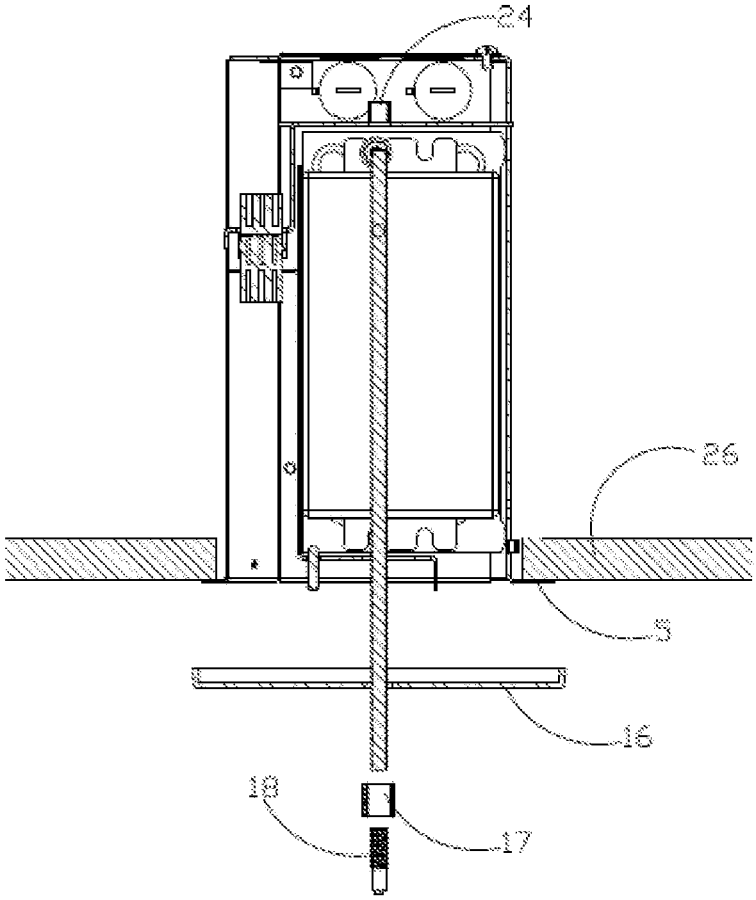

FIG. 13: Is a further perspective of the enclosure with a sectional view detailing the mounting hardware [17 & 18] and mounting rod [7].

Figure 14:
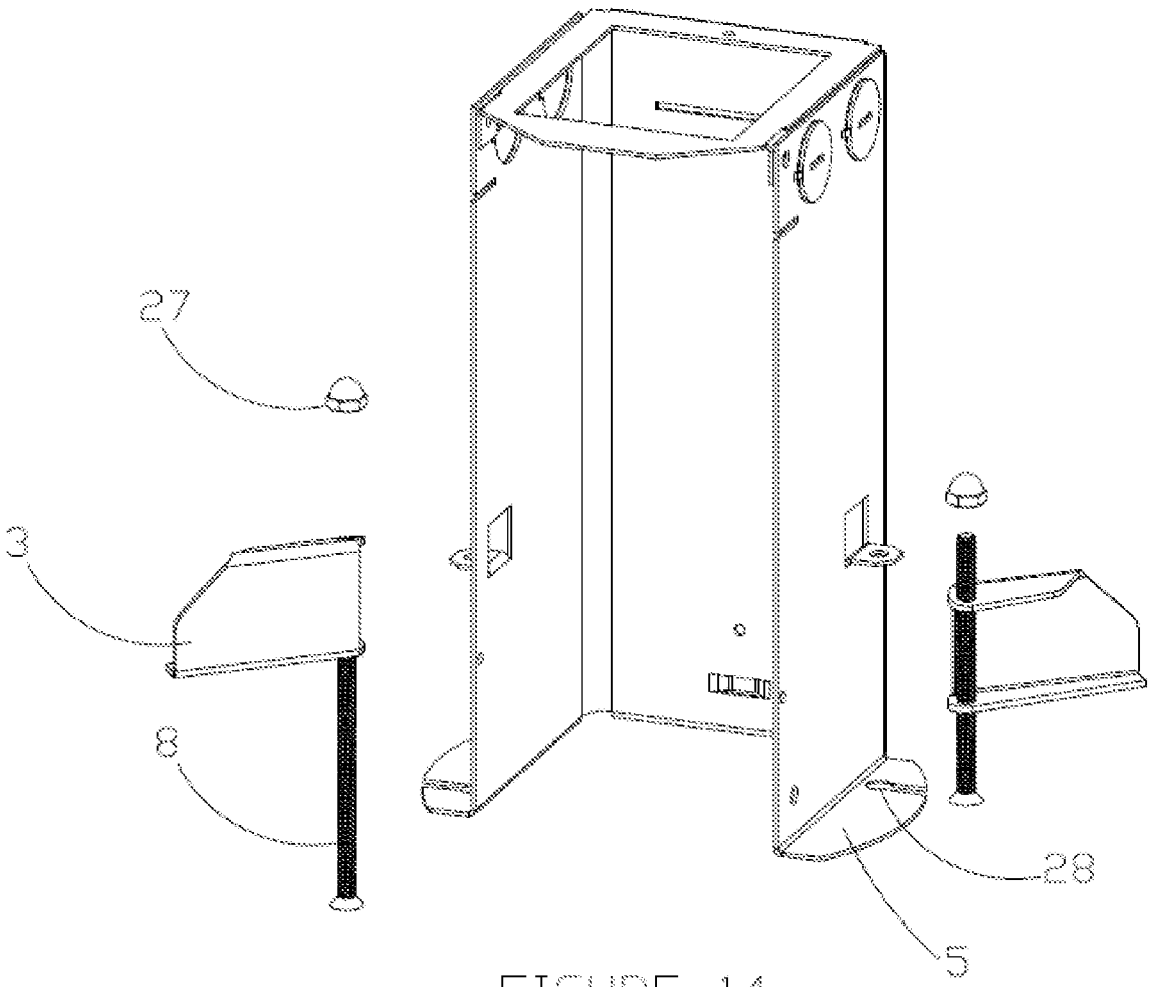

FIG. 14: Is a perspective of the level lug assembly and installation to the flange driver box housing. The level lug [3] is threaded onto the bolt [8], inserted into the housing flange [5] at the slot [28] and held captive with the acorn nut [27].

Figure 15:
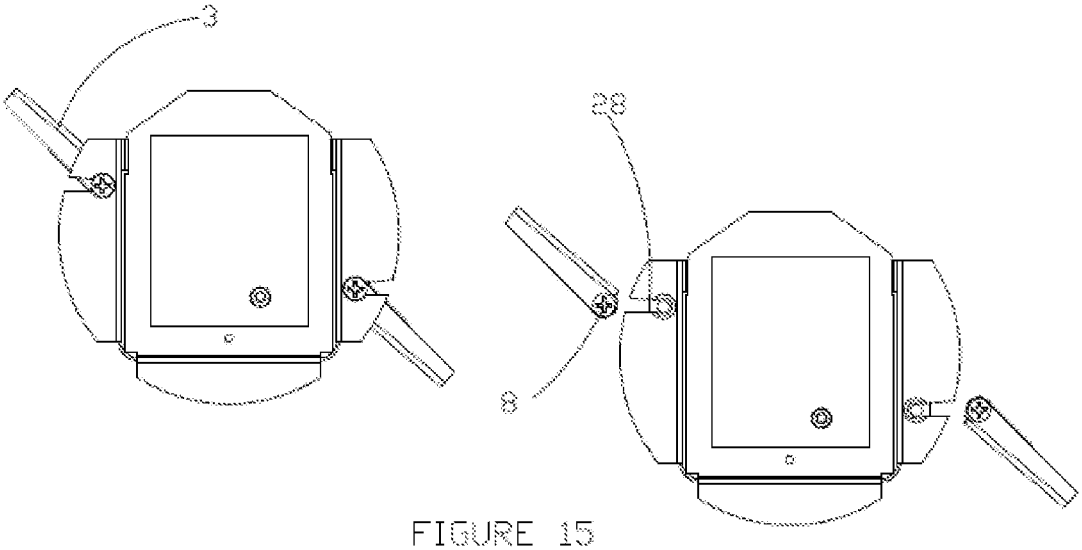

FIG. 15: Is a perspective of the flange driver box housing from the bottom view, and details how the level lugs are installed to the housing at the base flange [5] in the slot [28].

Figure 16:
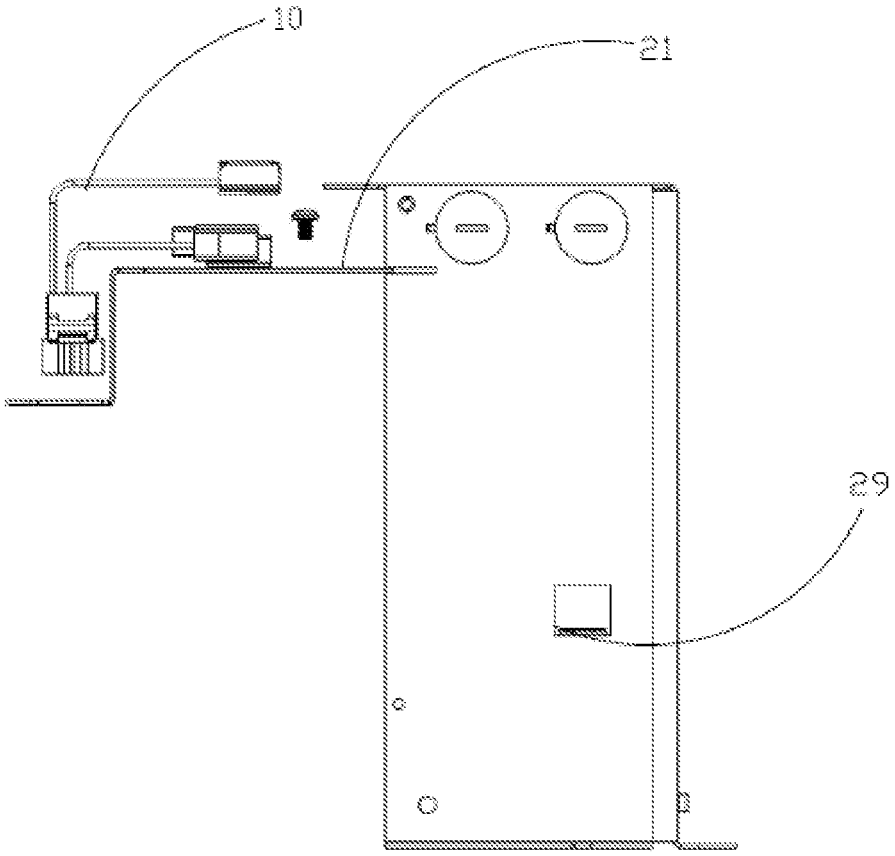

FIG. 16: Is a perspective of the flange driver box that details the installation of the wiring compartment divider bracket [21] and its associated electrical wiring harness [10].

Figure 17:
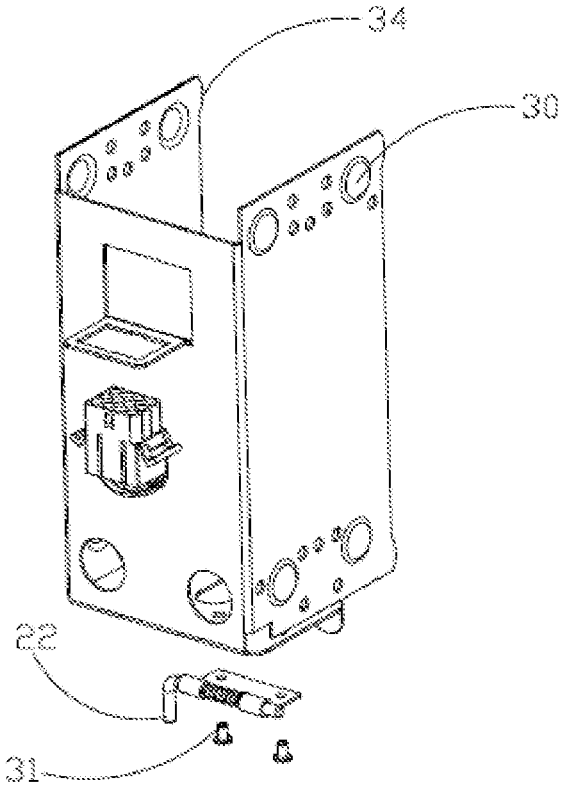

FIG. 17: Details features of the flange driver tray that help with its alignment [30] and direction [34] when inserted into the housing, and the securing spring latch [22].

Figure 18:
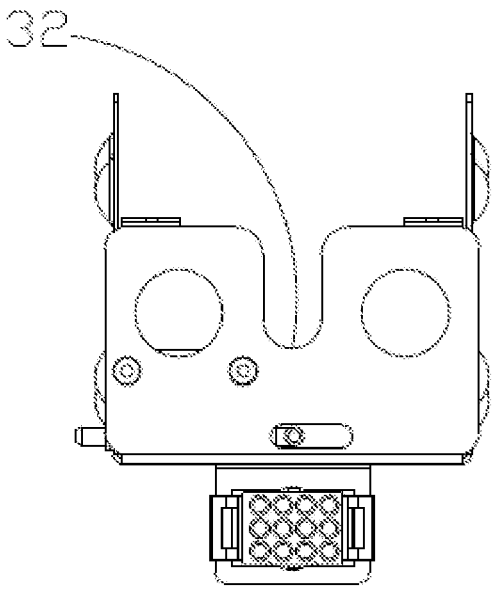

FIG. 18: Is a further perspective of the driver tray, the bottom view, where the U slot [32] is detailed. The U slot is for fixture-mounted driver tray removal.

Figure 19:
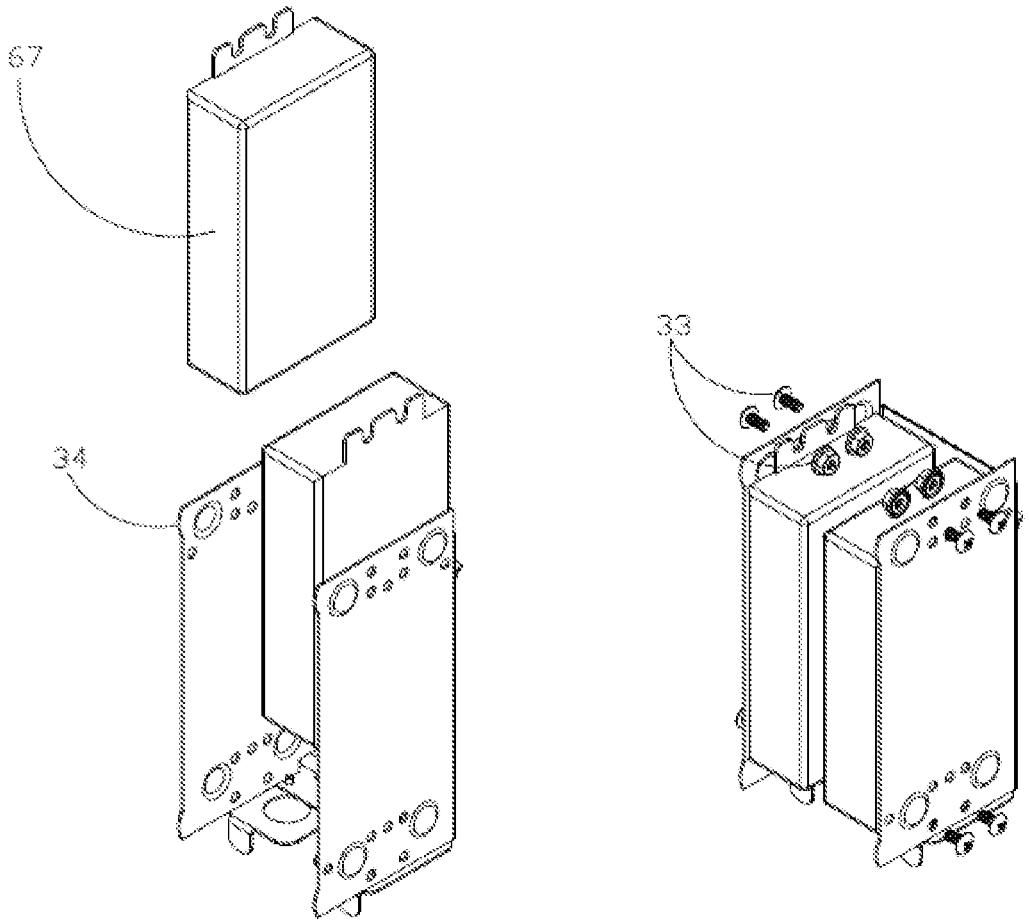

FIG. 19: Is a further perspective of the assembly of the LED components [67] to the flange driver tray where hardware [33] is used to install the LED drivers [67].

Figure 20:
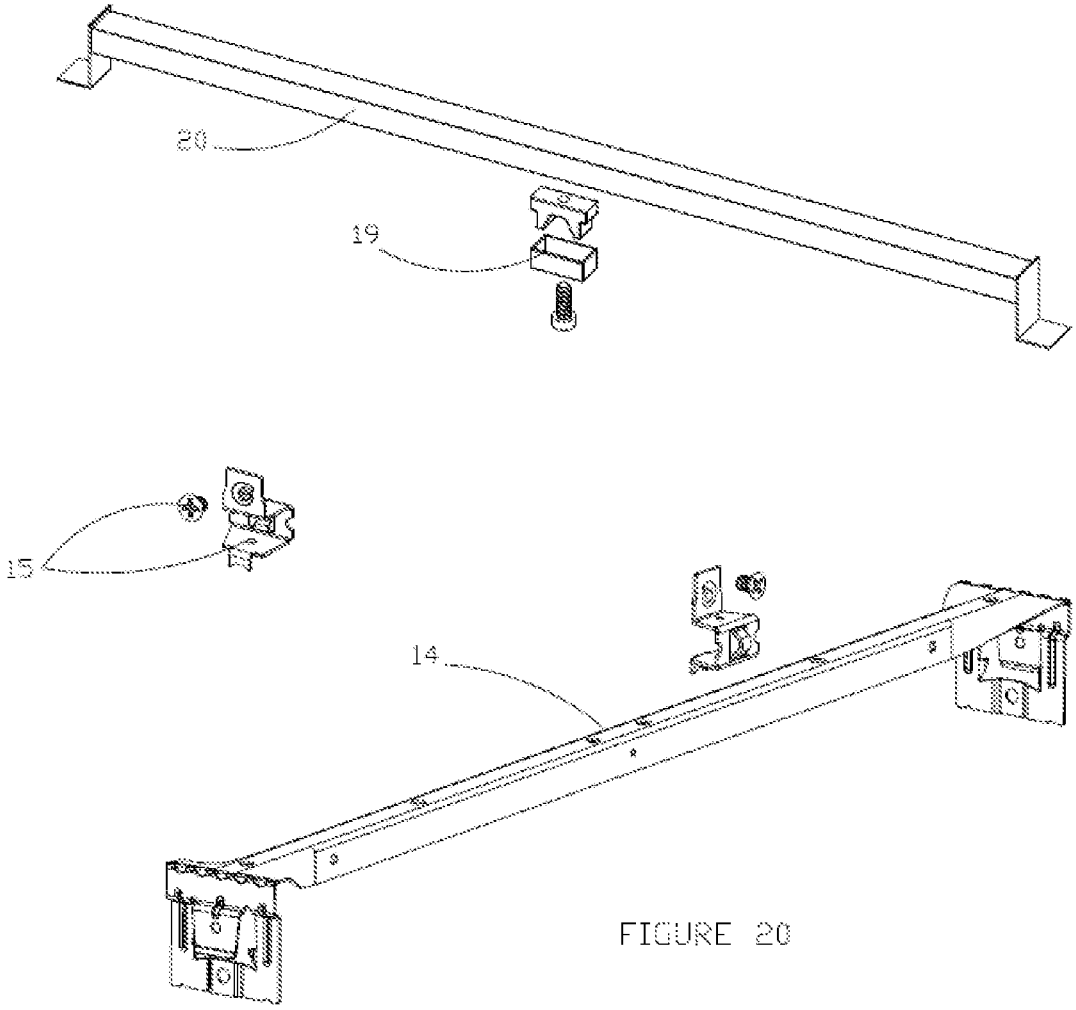

FIG. 20: Is a further perspective of the mounting items that are used in the new construction application of the flange driver box. The two different types of hanging bars for grid [14] and joist [20] installation are detailed along with their associated mounting hardware[15 & 19].

Figure 21:
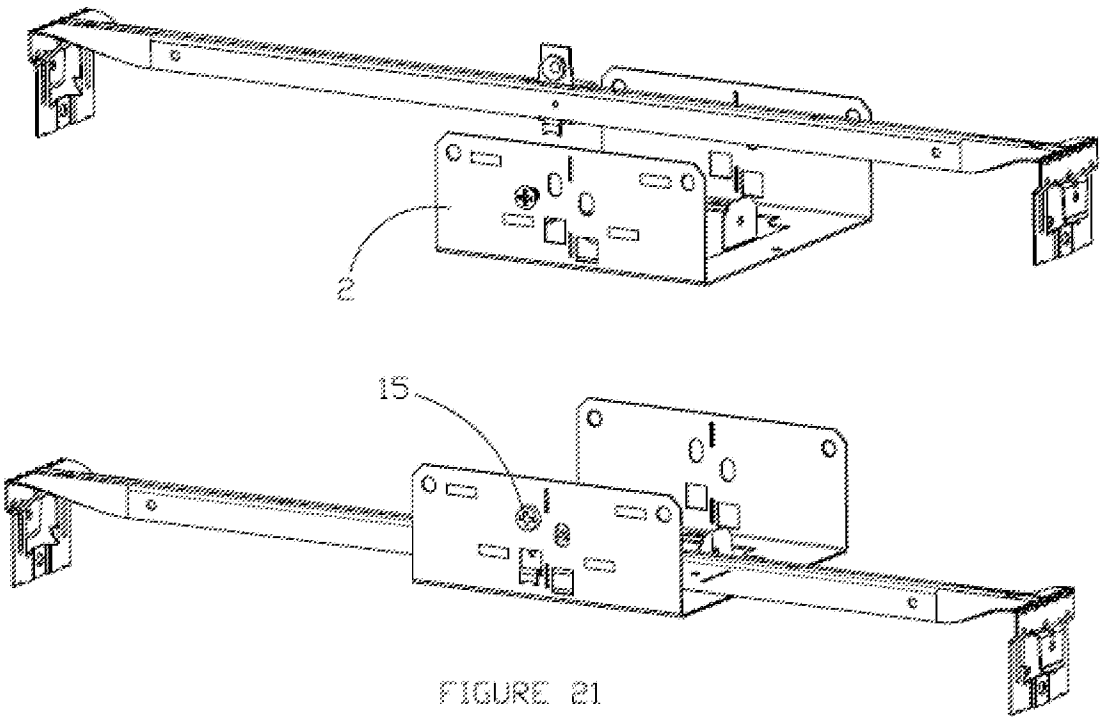

FIG. 21: Is a further perspective of the assembly of the grid hanging bars to the flange mounting bracket [2] by hardware [15].

Figure 22:
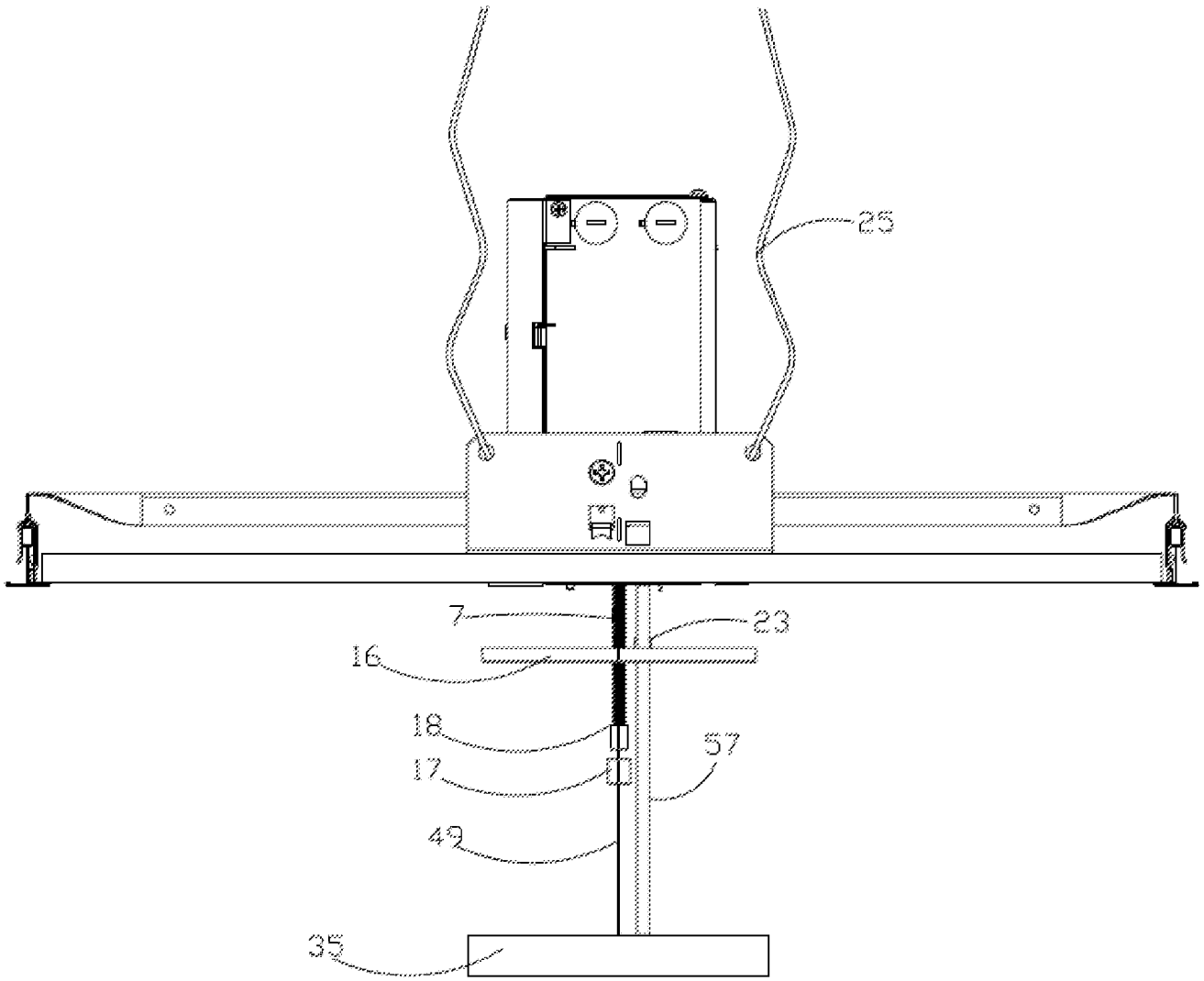

FIG. 22: Is an exploded view of the mounting hardware to a fully mounted flange driver box for a new construction application, where the grid hanger bars are utilized. The fixture [35] is secured by aircraft cable [49] and the LEDs are powered by low voltage cord [57]. The mounting hardware [7, 18, 19] are all used and the flange box ceiled to an open environment by the canopy [16]. The low voltage cord uses the strain relief [23] in the canopy to remain taught.

Figure 23:
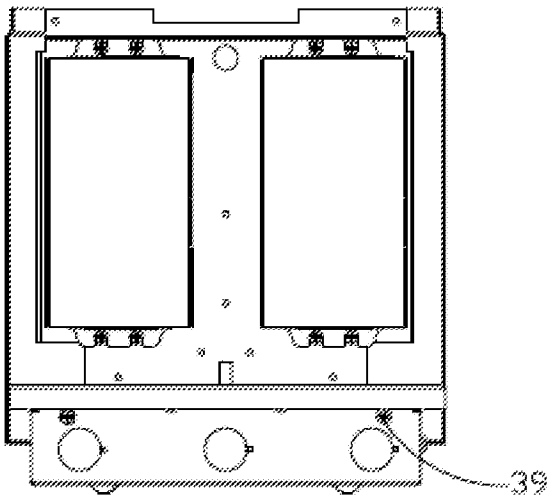
FIGS. 23-33 show one embodiment of the driver box, the Surface driver box (SRB).
Figure 23:
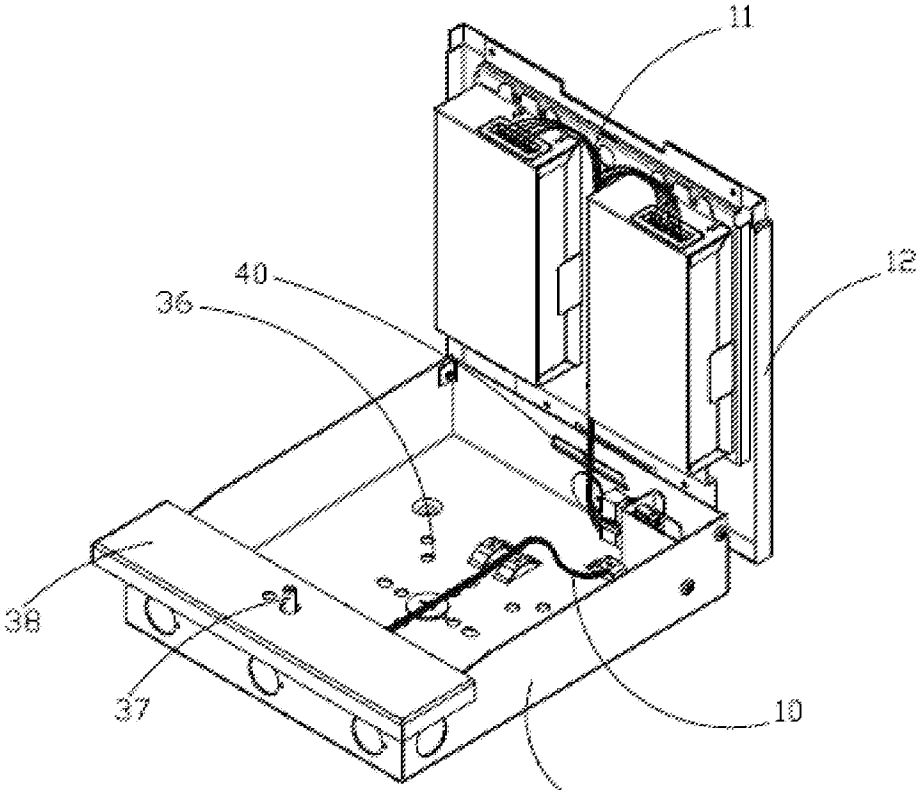

FIG. 23: Is a perspective of the surface driver box with the driver tray hooked onto the housing, providing a view of the driver box housing internal components, features, and the trays own features. The mounting point [37] can be seen, along with the fixed canopy [38]. The mounting holes [36] are shown, and the electrical whips [11 & 10].

Figure 24:
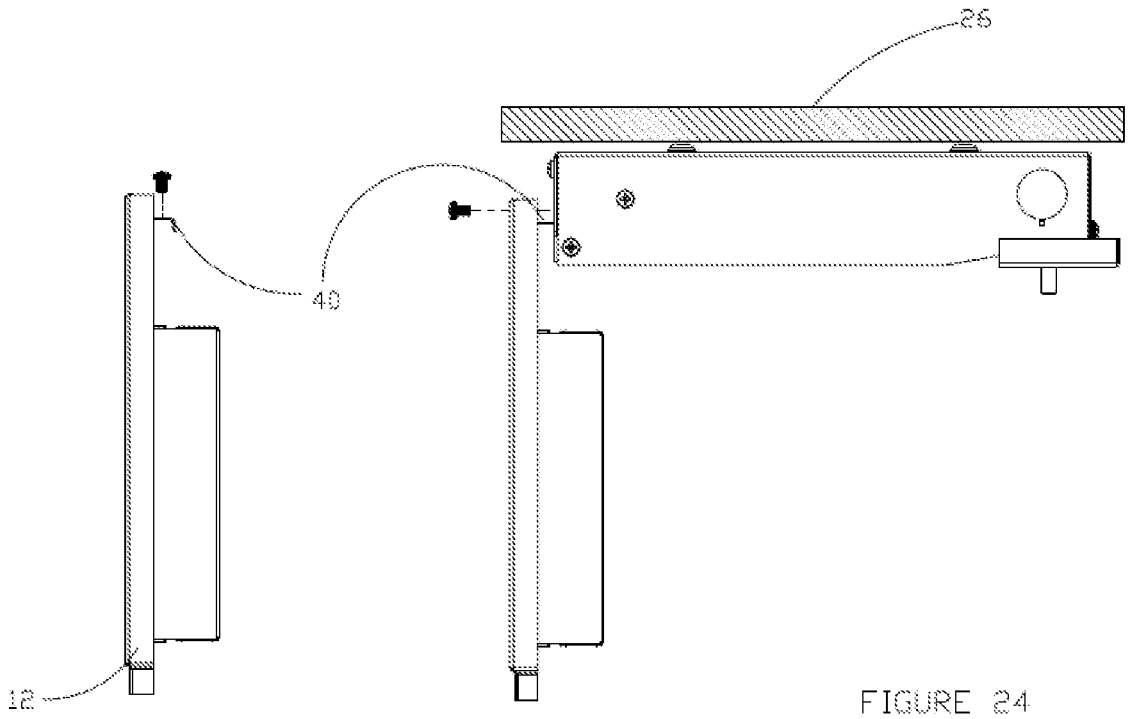

FIG. 24: Is a further perspective of the surface driver box installed to the ceiling structure [26], where the driver tray [12] is hooked onto the housing [40] for maintenance, initial building connection, or other means to access the housing cavity while keeping the driver tray near.

Figure 25:
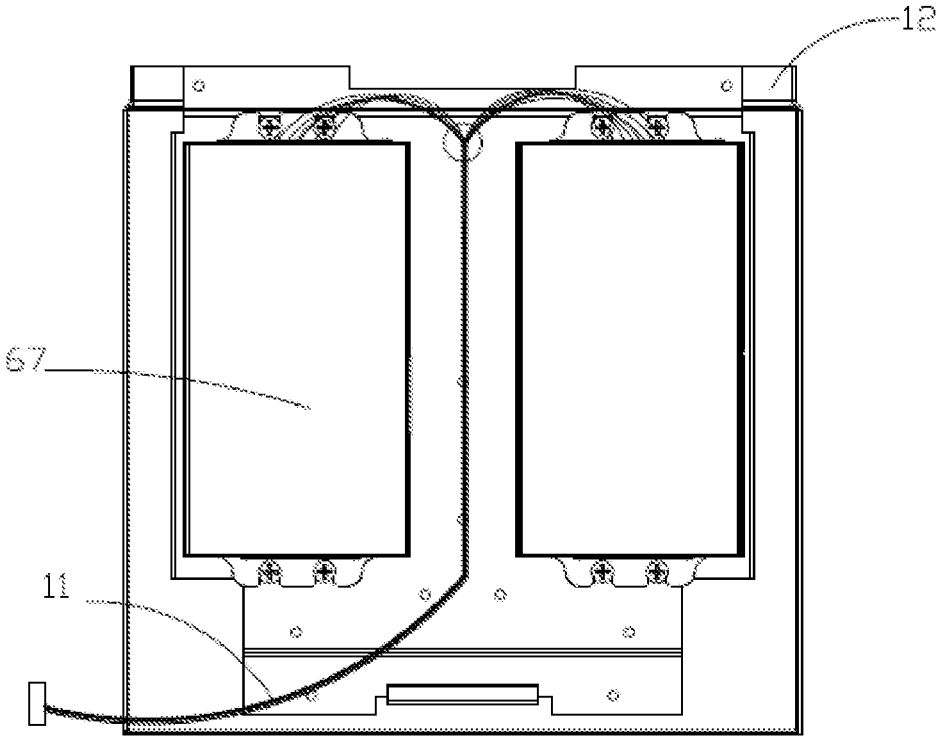

FIG. 25: Is a perspective of one of the embodiments for the surface driver tray [12] and its wiring harness [11] to the LED components [67]

Figure 26:
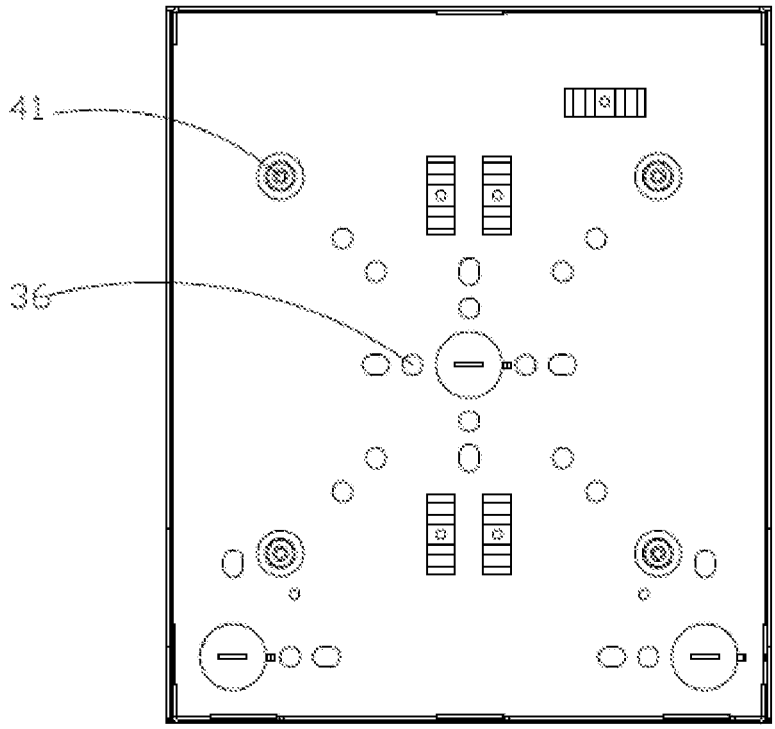

FIG. 26: Is a detailed view of the housing, where the mounting points [36] are seen in more detail. The dimples [41] that help installation with uneven surfaces are also shown.

Figure 27:
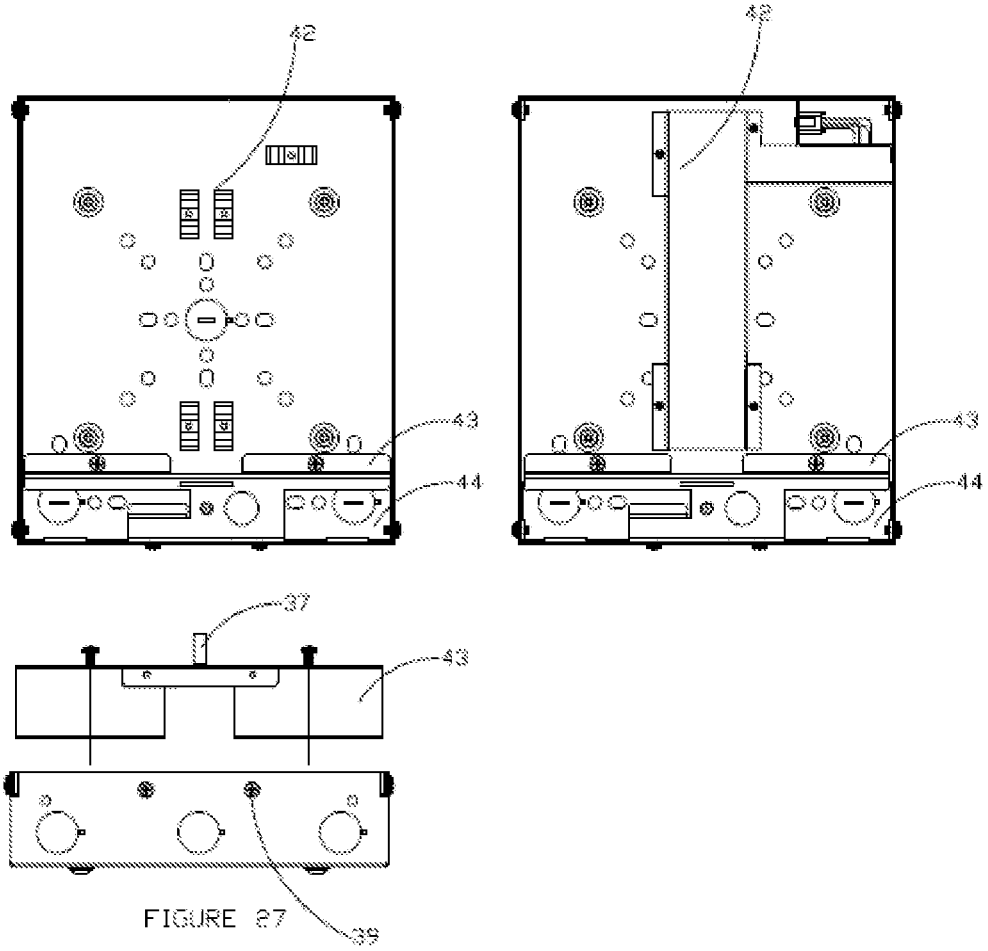

FIG. 27: Is a detailed perspective of the assembly of the luminaires mounting bracket [43] installation to the surface box housing with hardware [39]. The fixture mounting point [37] is shown. Additionally the isolated high voltage compartment bracket can be seen with the wire raceway [42].

Figure 28:
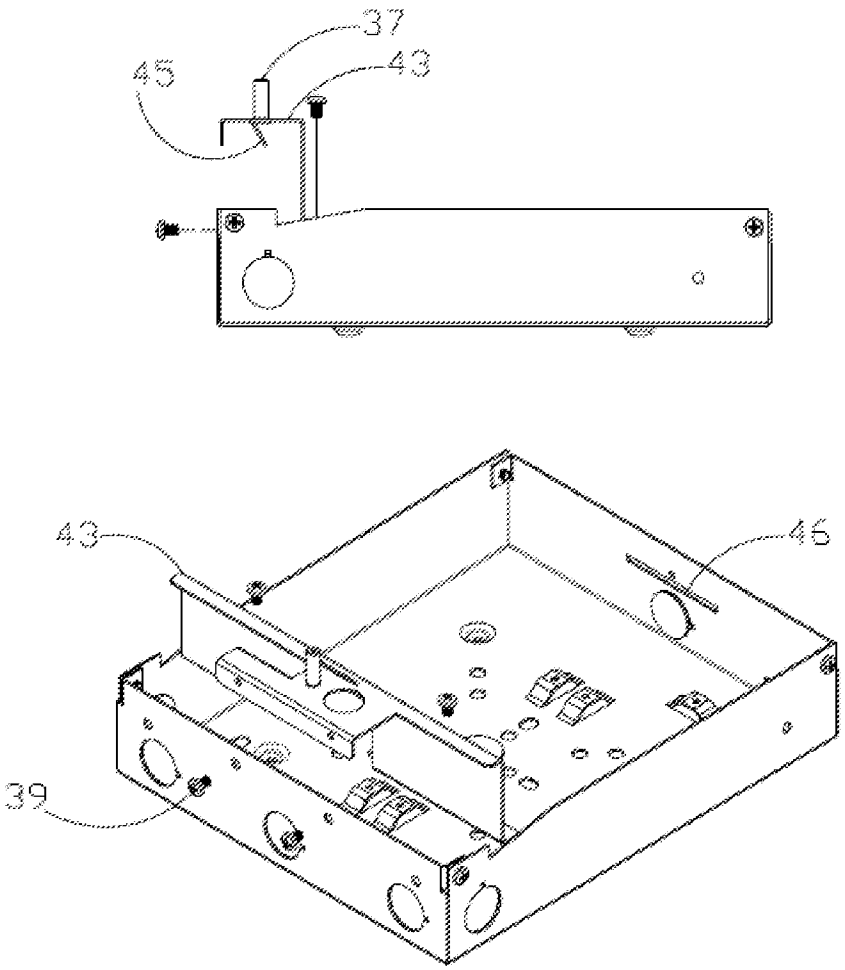

FIG. 28: Is a further perspective of the installation of the mounting bracket [43] to the housing with hardware [39 & 42], and fixture mounting point [37]. The obround slot [46] for the driver tray hook is shown. The mounting bracket has a flange bend [45] detailed and used to direct the low voltage cable [57] into the housing.

Figure 29:
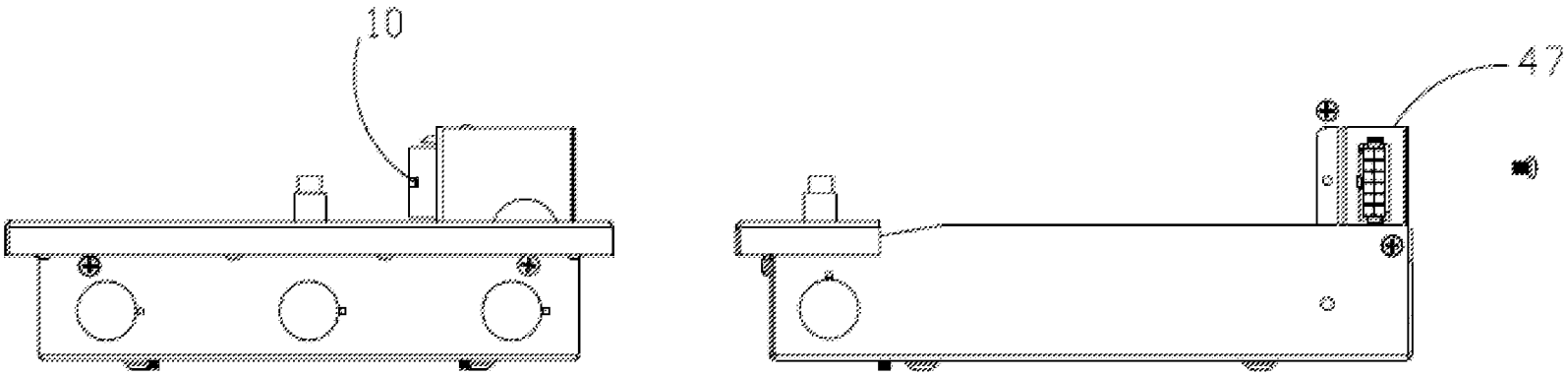

FIG. 29: Is a perspective of the wiring bracket [47] to the housing. The bracket serves as a panel mount bracket to install the contractor wiring harness [10].

Figure 30:
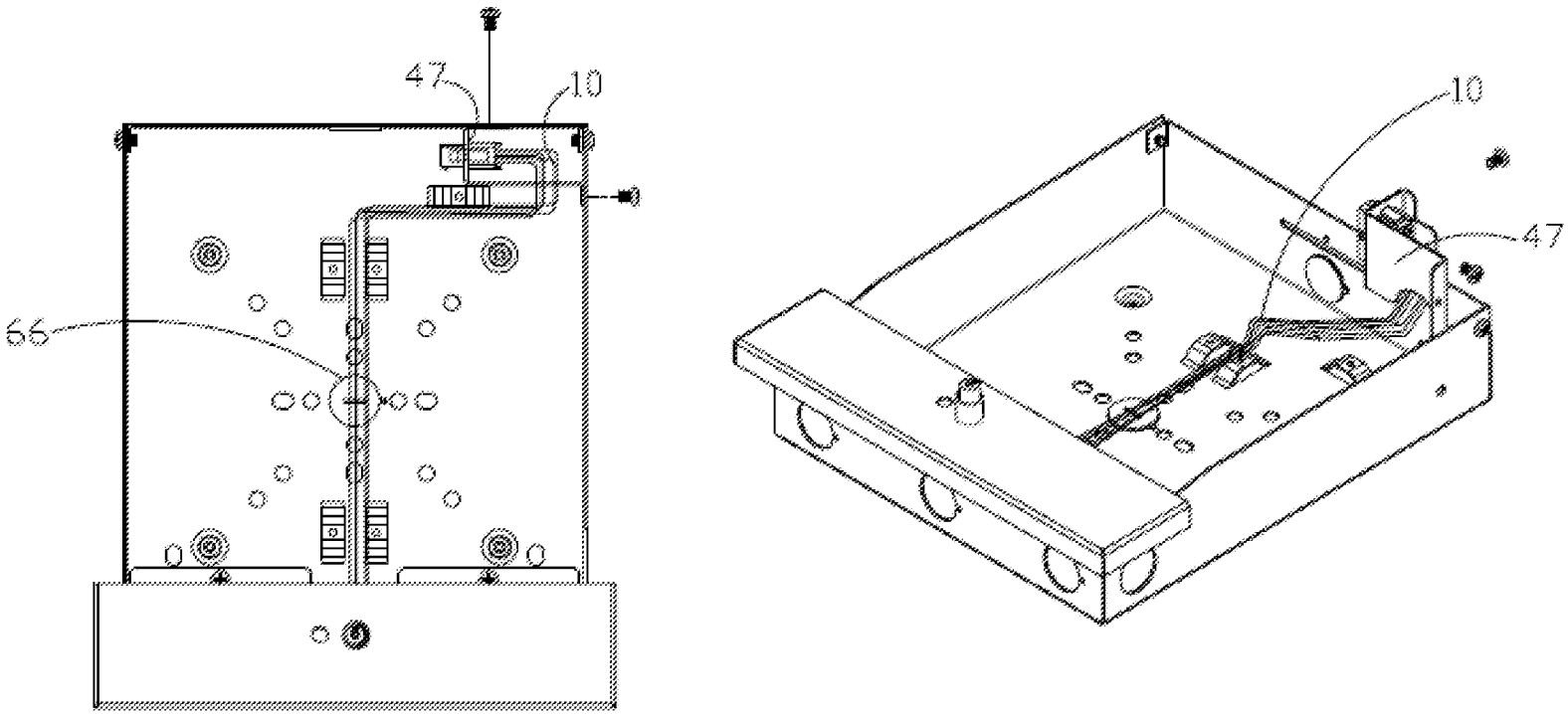

FIG. 30: Is a further perspective of the installation of the wiring bracket [47] and wiring harness [10] to the housing. The center knock out [66] is also detailed.

Figure 31:
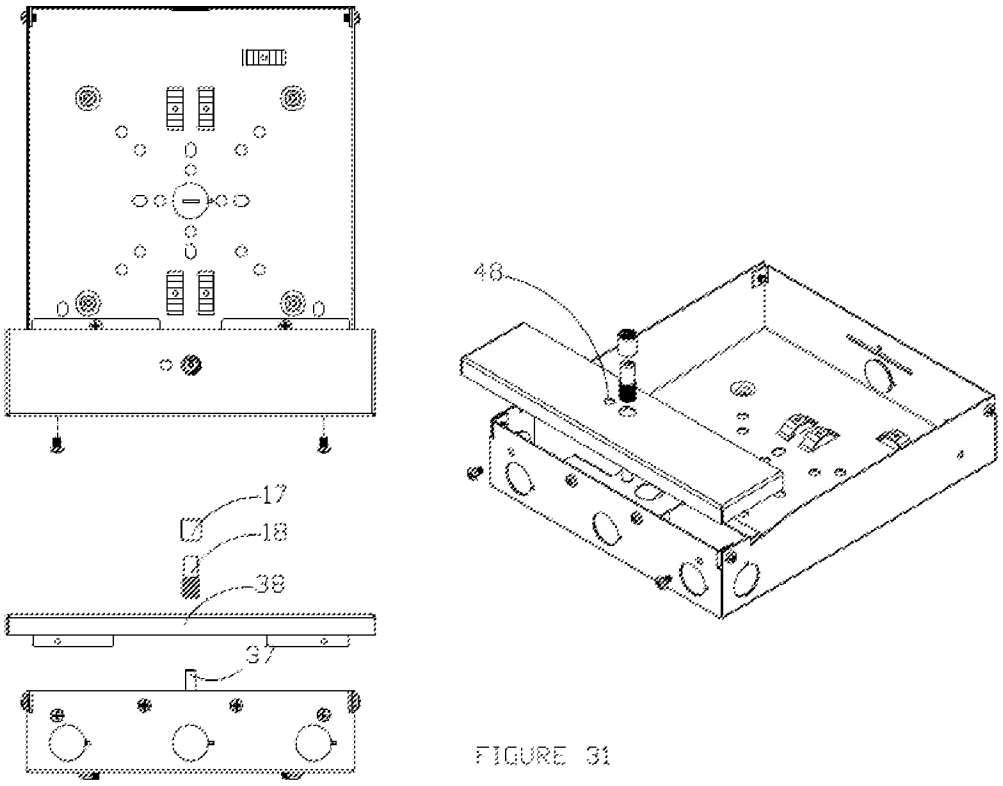

FIG. 31: Is a detailed view of the installation of the fixed canopy bracket [38] to the surface box housing, and the associated luminaire mounting hardware [17 & 18] to the mounting point [37] The fixture low voltage cable is inserted into the fixed canopy hole [48].

Figure 32:
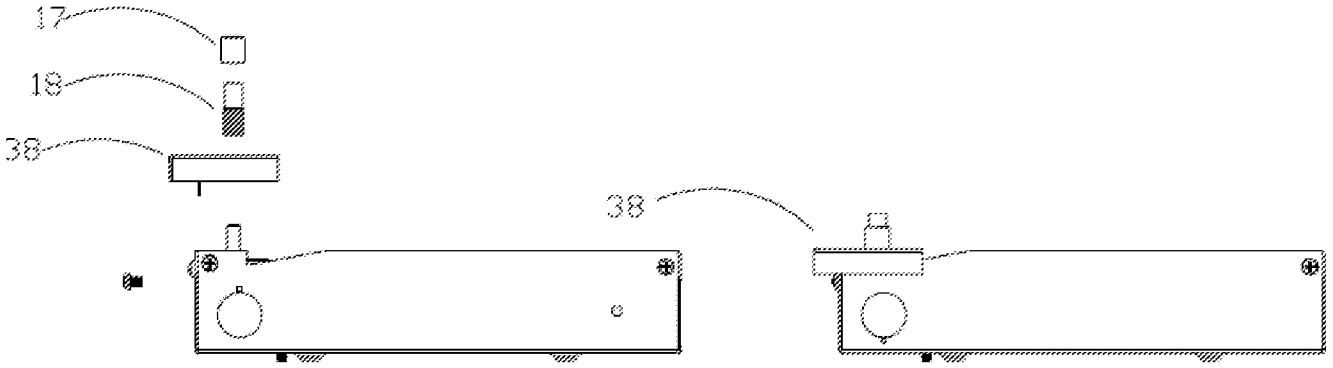

FIG. 32: Is a further perspective of the fixed canopy [38] installation to the housing, and an exploded view of the associate luminaire mounting hardware [17 & 18].

Figure 33:
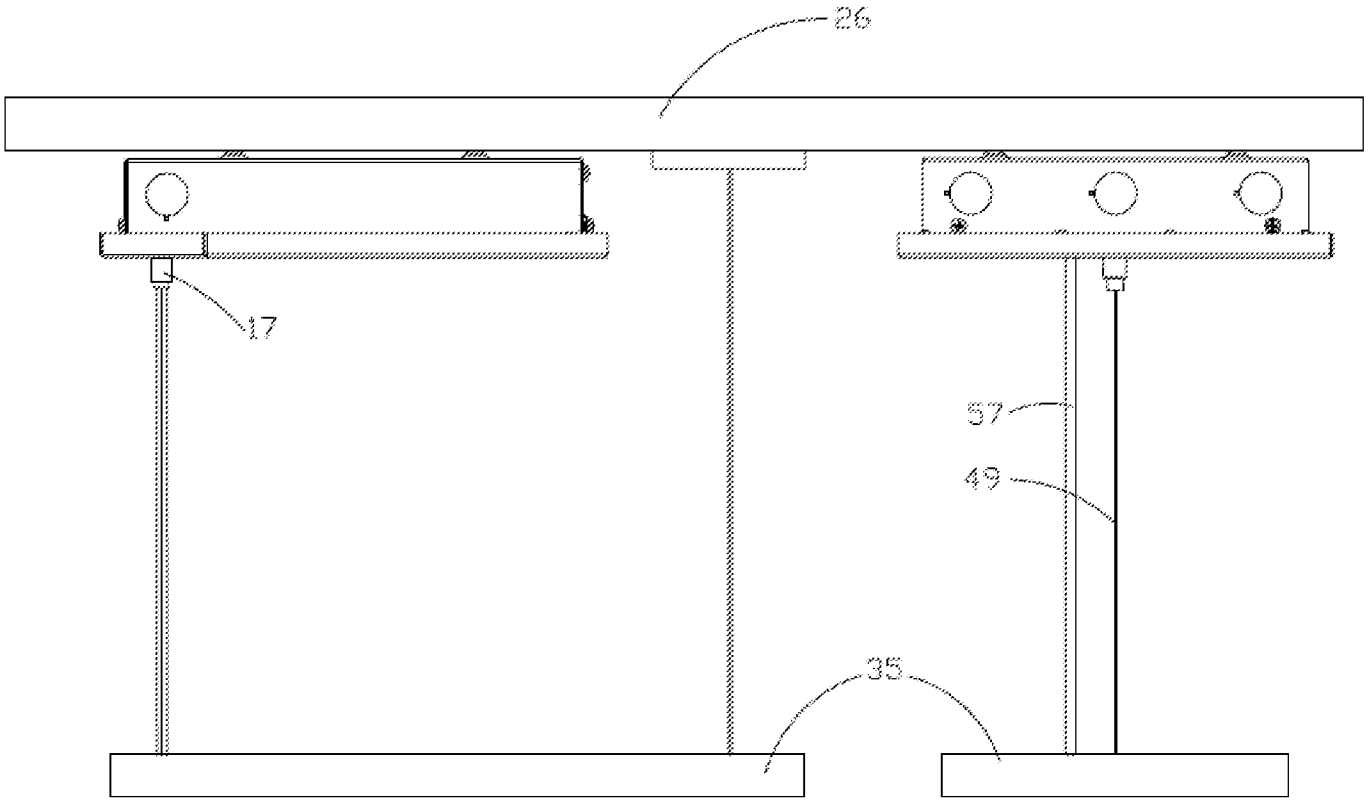

FIG. 33: Is a detailed view of the fully assembled surface driver box, with the luminaire [35] installed. The box is secured to a surface [26]. The fixture is fixed by aircraft cable [49] and electrically connected by the low voltage cord [57]. The box can be accessed by removing the slip ring [17] mounting hardware, while also keeping the fixture installed.

Figure 34:
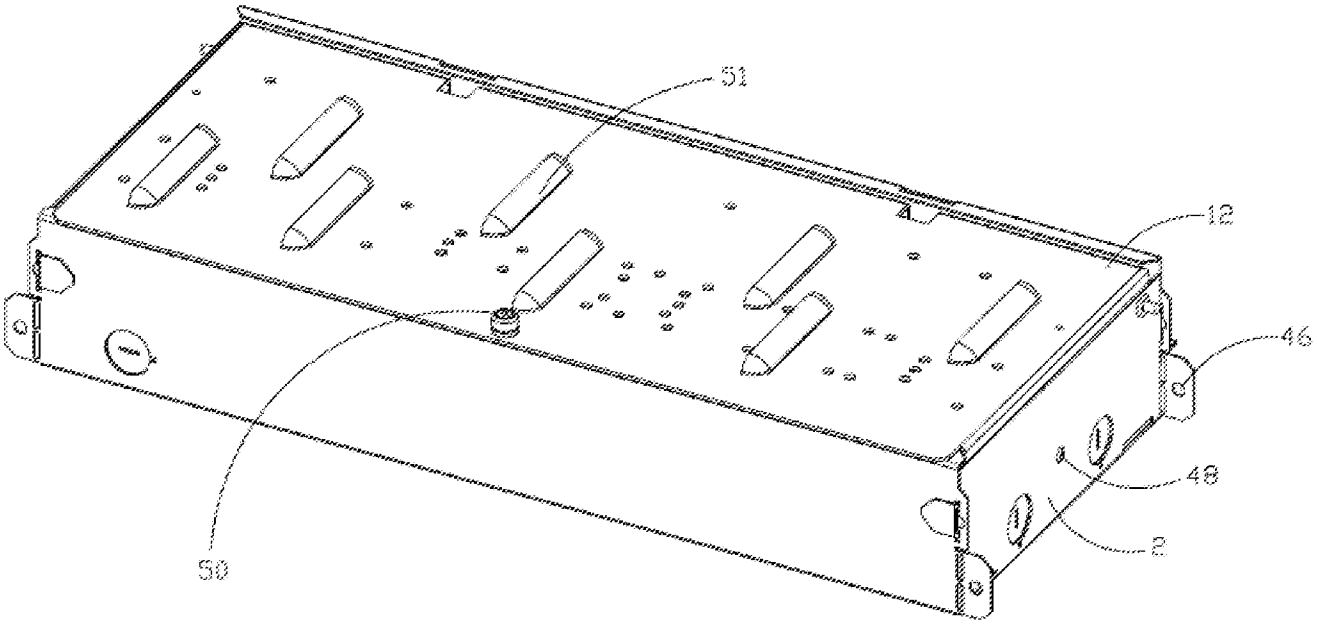
FIGS. 34-47 show another embodiment of the driver box, the Grid driver box (GRB).

FIG. 34: Is a perspective of the grid driver box embodiment where the driver tray [12] is fully closed by the captive PEM [50] to the housing [2] The box can be tied back with tie-back wire from the housing holes [46]. The low voltage cord enters the box through one of the housing holes [48]. The driver tray louvers [51] are detailed and utilized for heat dissipation.

Figure 35:
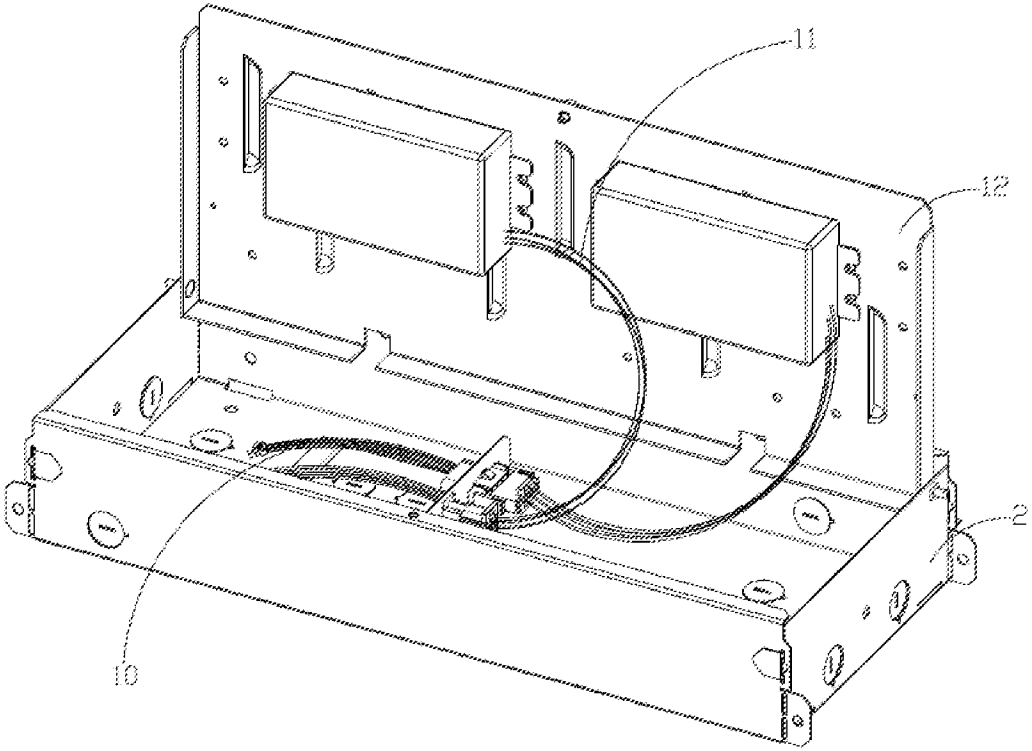

FIG. 35: Is a further perspective of the grid driver box embodiment with the driver tray [12] pivoted open. All the LED driving components are detailed in this figure, along with the interaction of the wiring harnesses [11] from the removable driver tray to the contractors isolated building wire [10] connection compartment.

Figure 36:
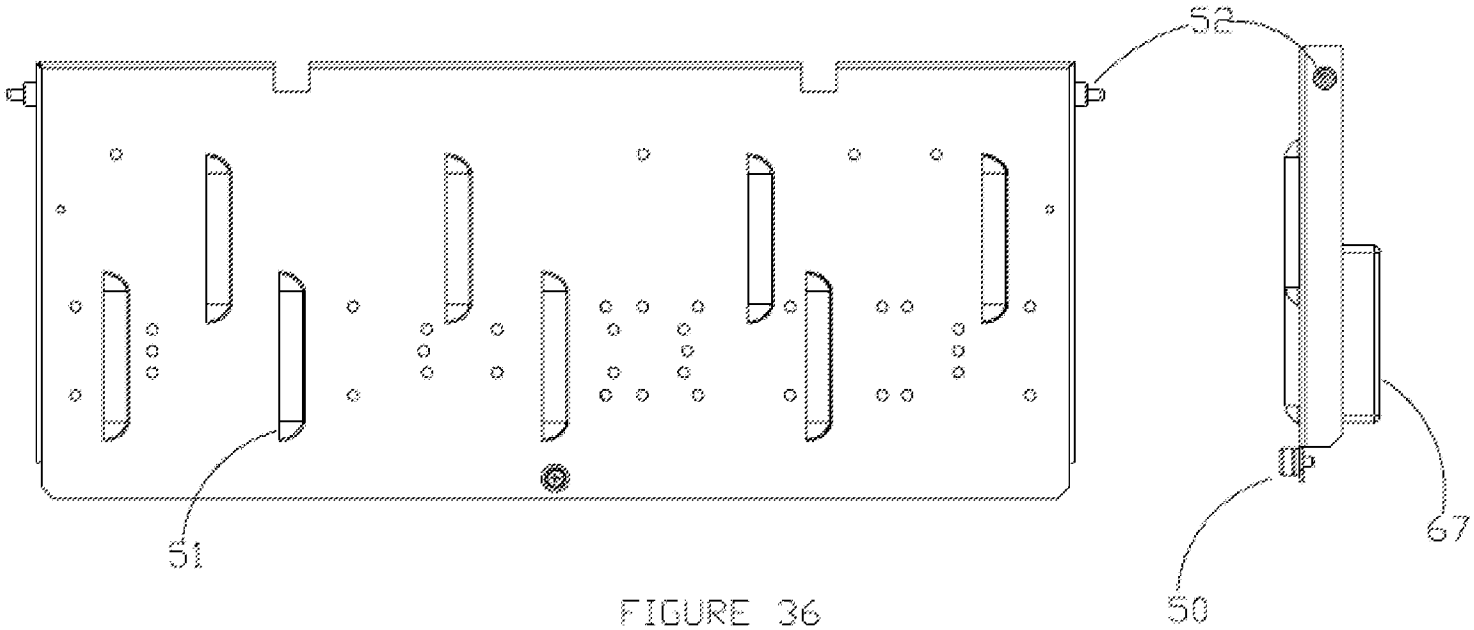

FIG. 36: Is a further perspective of the grid driver tray with detailed callouts for the pivot point and quick release system [52], and the captive screw [50] that is used to secure the driver tray to the housing. The louvers [51] are used for heat dissipation. The LED drivers [67] are also shown.

Figure 37:
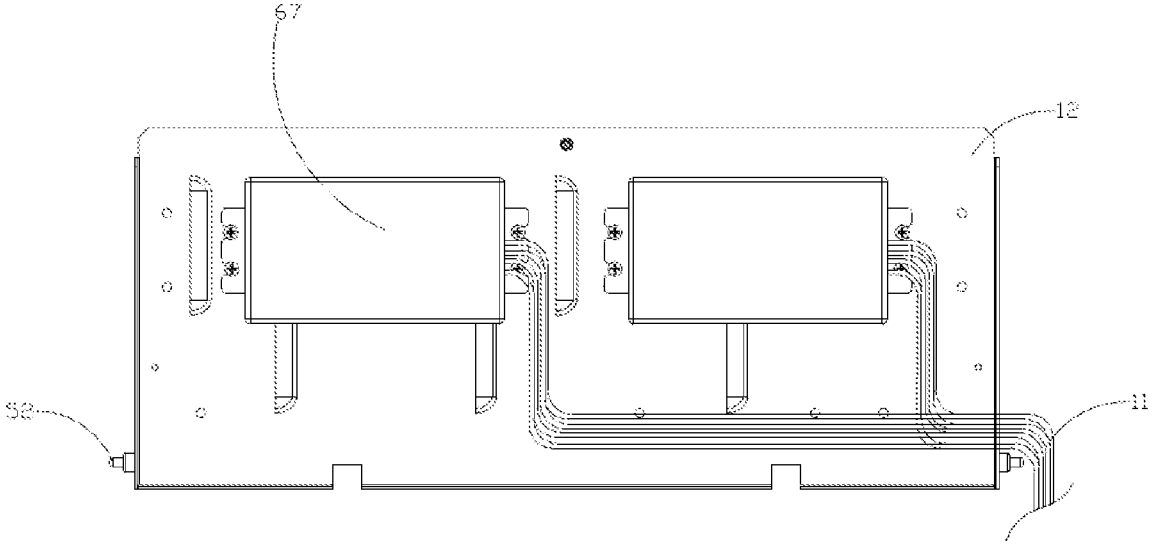

FIG. 37: Is a further detailed perspective of the driver tray [12] with the LED components [67], the wiring harness [11], and the pivot point [52] release system.

Figure 38:
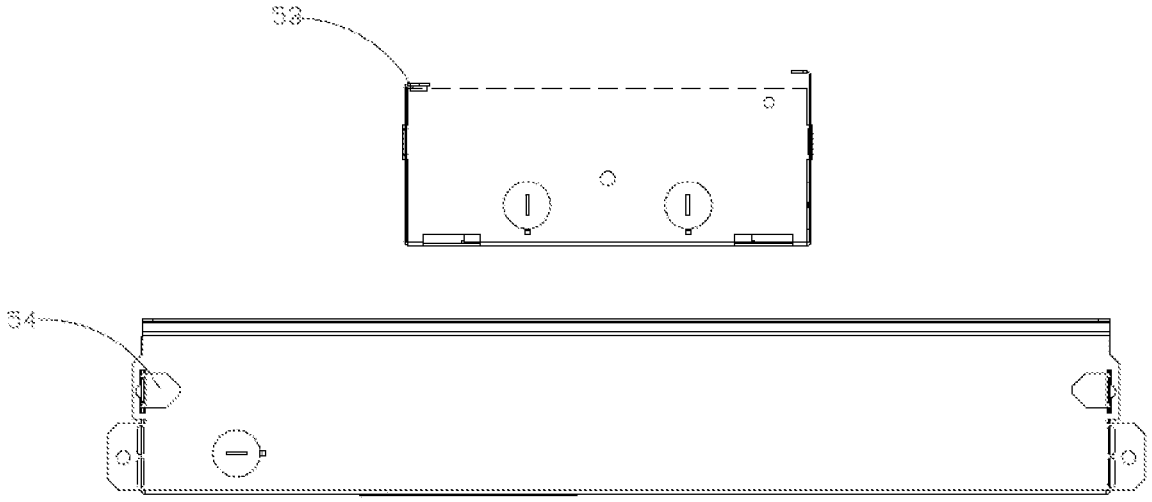

FIG. 38: Is a perspective of the grid driver box housing and the PEM nut [52], that takes the captive screw from the driver tray to create a securing method between the two components. The box has a simple, tool-less and hardware-less install by bendable tabs [54] shown in this figure.

Figure 39:
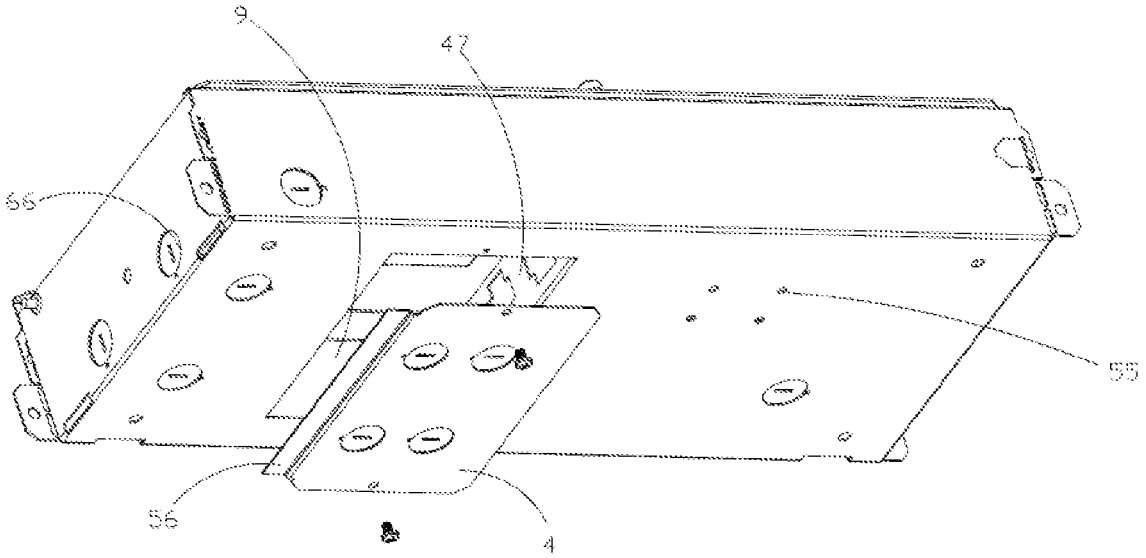

FIG. 39: Is a detailed perspective of the installation of the grid driver box access plate [4] assembly. The access plate flange [56] is for ease of install. The wiring harness panel mount bracket [47] and wiring compartment area [9] are shown with the access plate exploded. The various knock outs [66] are also detailed. Along with zip tie holes [55] added for ease of wire management for installers.

Figure 40:
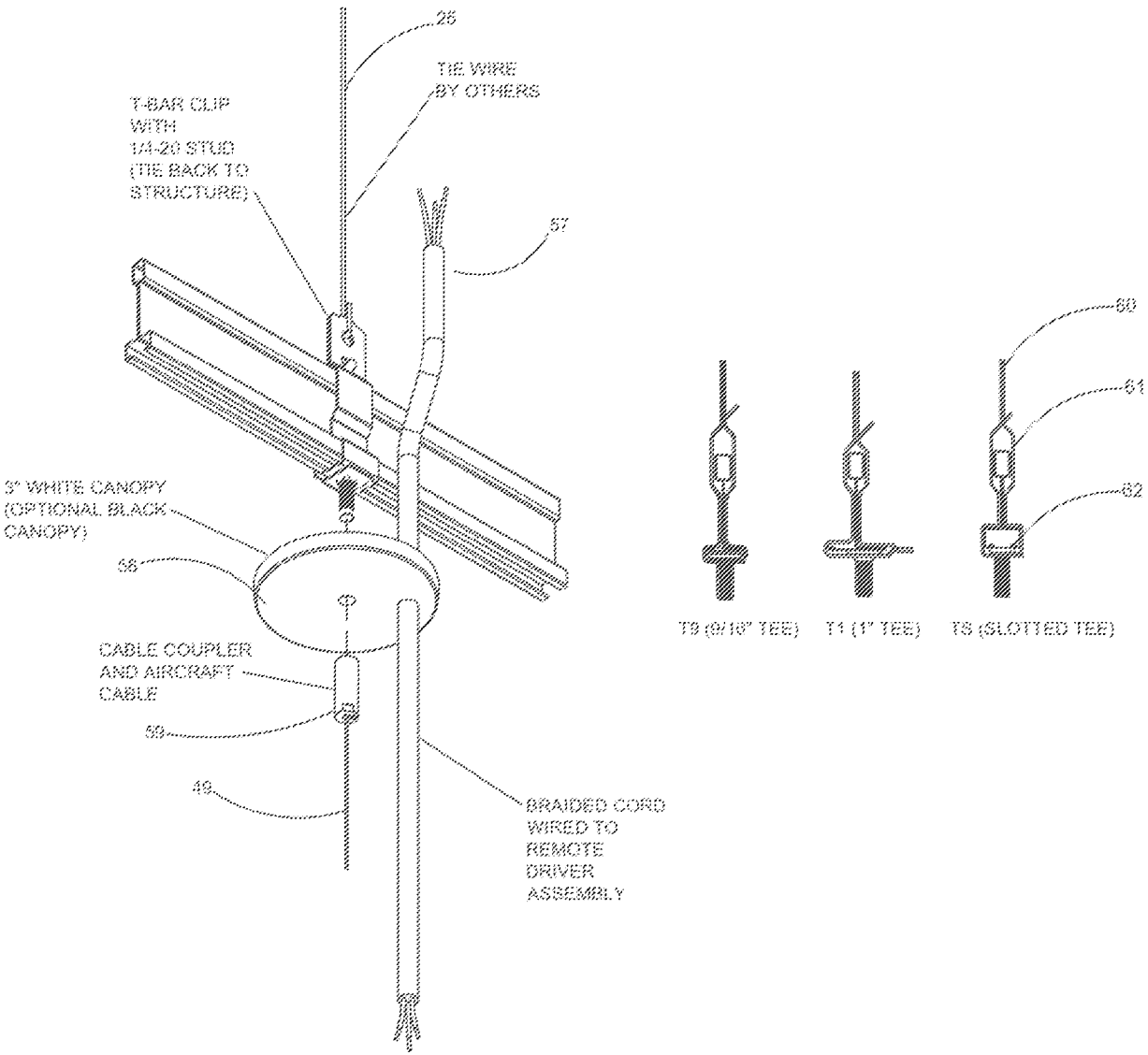

FIG. 40: Is a detailed perspective of the fixtures mounting point [62] utilized for the grid driver box embodiment. It details the hardware used to install the fixture to the ceiling interface. The t-bar clip [60] snaps over the tee [61] and mounting bolt [62]. The fixture is secured to the air craft cable [49] and coupler [59]. All hardware is hidden by the decorative canopy [58]. The fixture is electrically connected by the low voltage cable [57].

Figure 41:
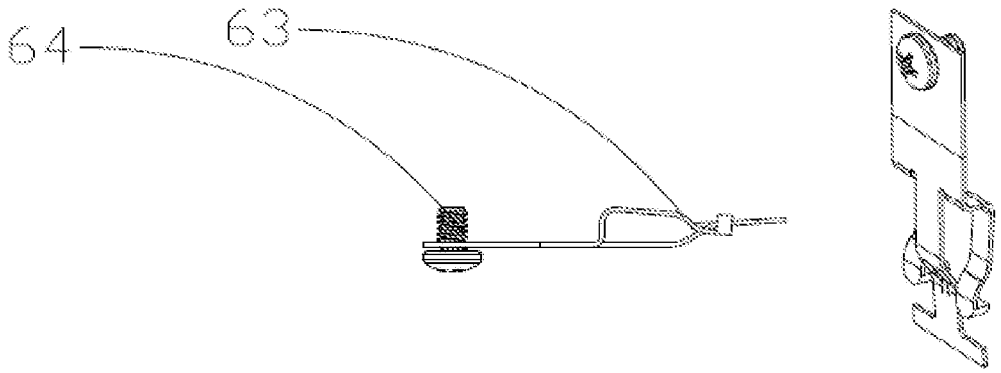

FIG. 41: Is a detailed view of the hardware [63 & 64] used and assembled to the grid driver box, FIG. 34, that are used to mount the grid driver box to the T-Grid ceiling structure.

Figure 42:
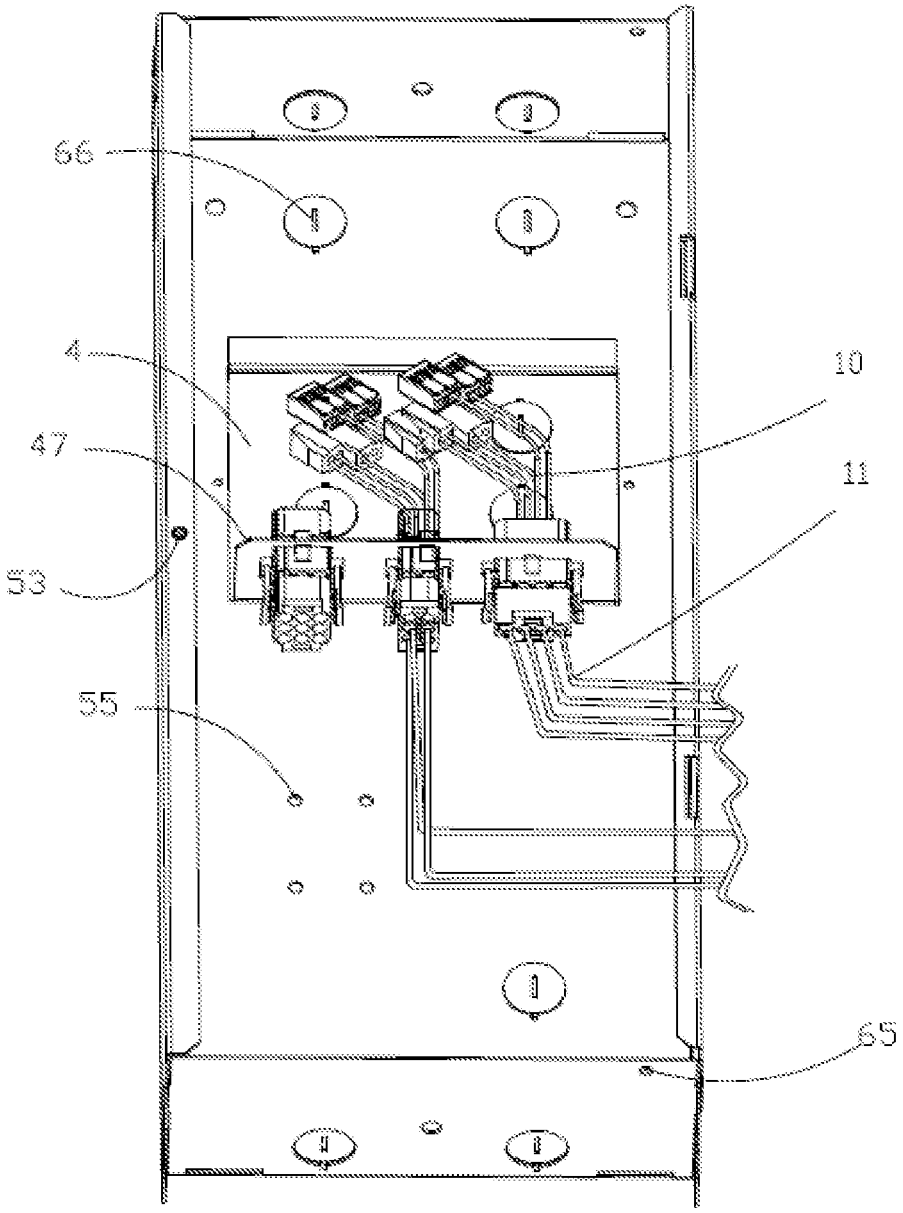

FIG. 42: Is a detailed perspective of the wiring compartment panel mount bracket [47] and of the grid box embodiment. Both the contractor whip [10] and the driver tray whip [11] are shown. The driver tray pivot point hole [65] is shown.

Figure 43:
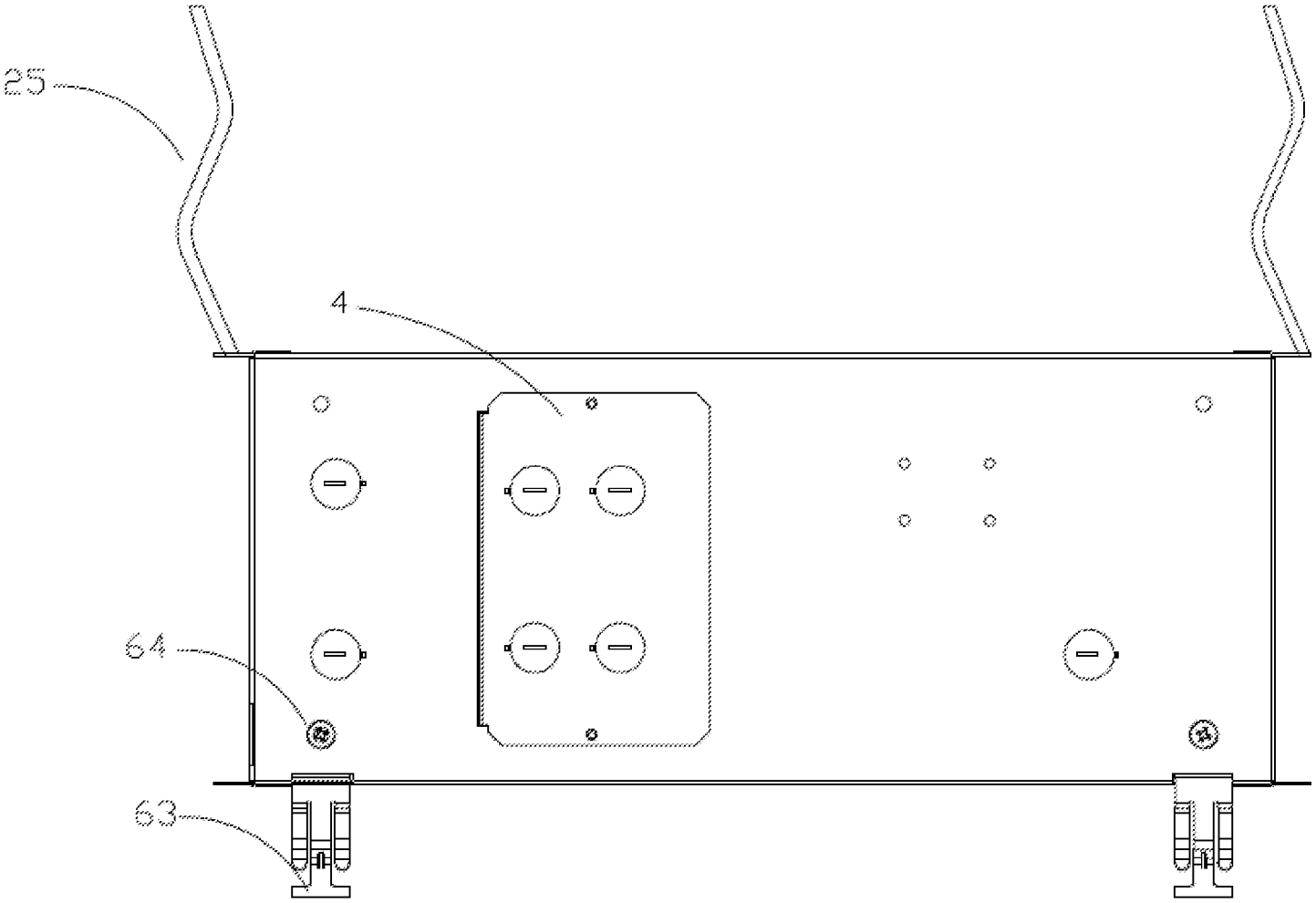

FIG. 43: Is a further perspective of the grid box installed to the t-grid by the mounting hardware [63 & 64] in FIG. 41 and securing tied back to the ceiling structure by tie back wire [25].

Figure 44:
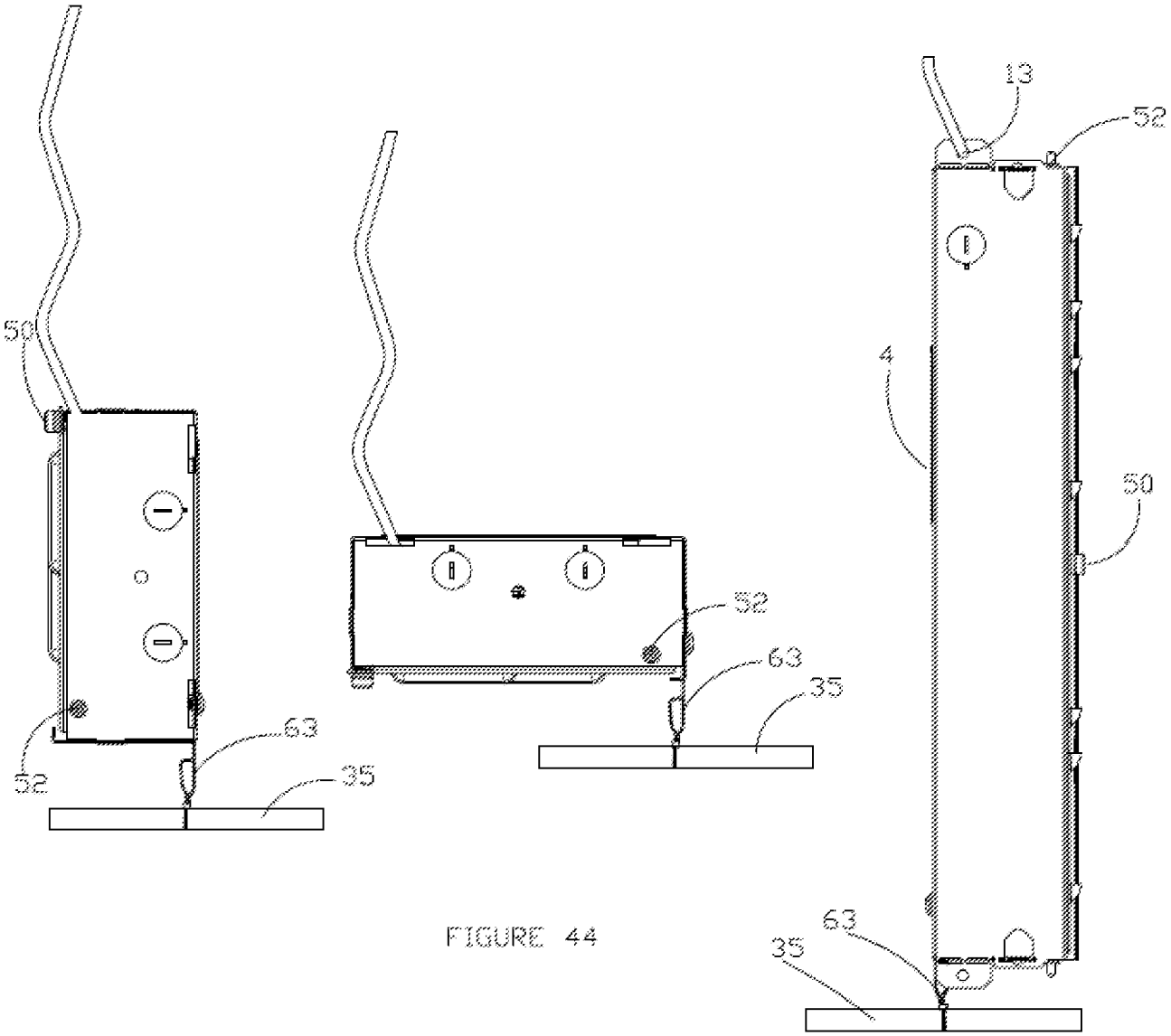

FIG. 44: Is a detailed perspective of the grid driver box being installed in many different orientations, due to the possible need to avoid ceiling plenum systems. The fixture [35], mounting hardware [63], tieback wire [25] and the driver tray pivot hardware/point [52] are all detailed in this figure.

Figure 45:
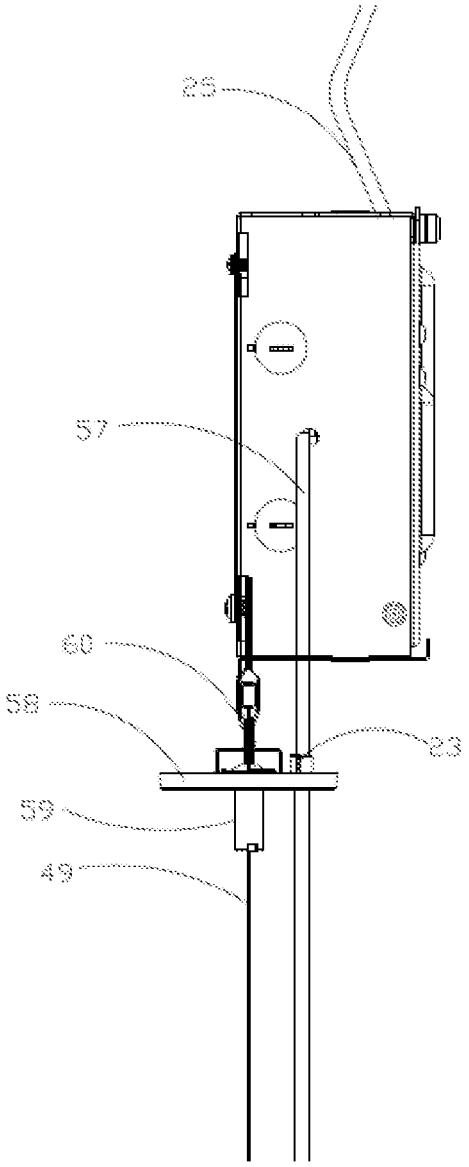

FIG. 45: Is a detailed perspective of one mounting orientation of the grid driver box and all it's necessary luminaire mounting hardware [60, 59, & 49]. The low voltage strain relief [23] and canopy [58] are shown.

Figure 46:
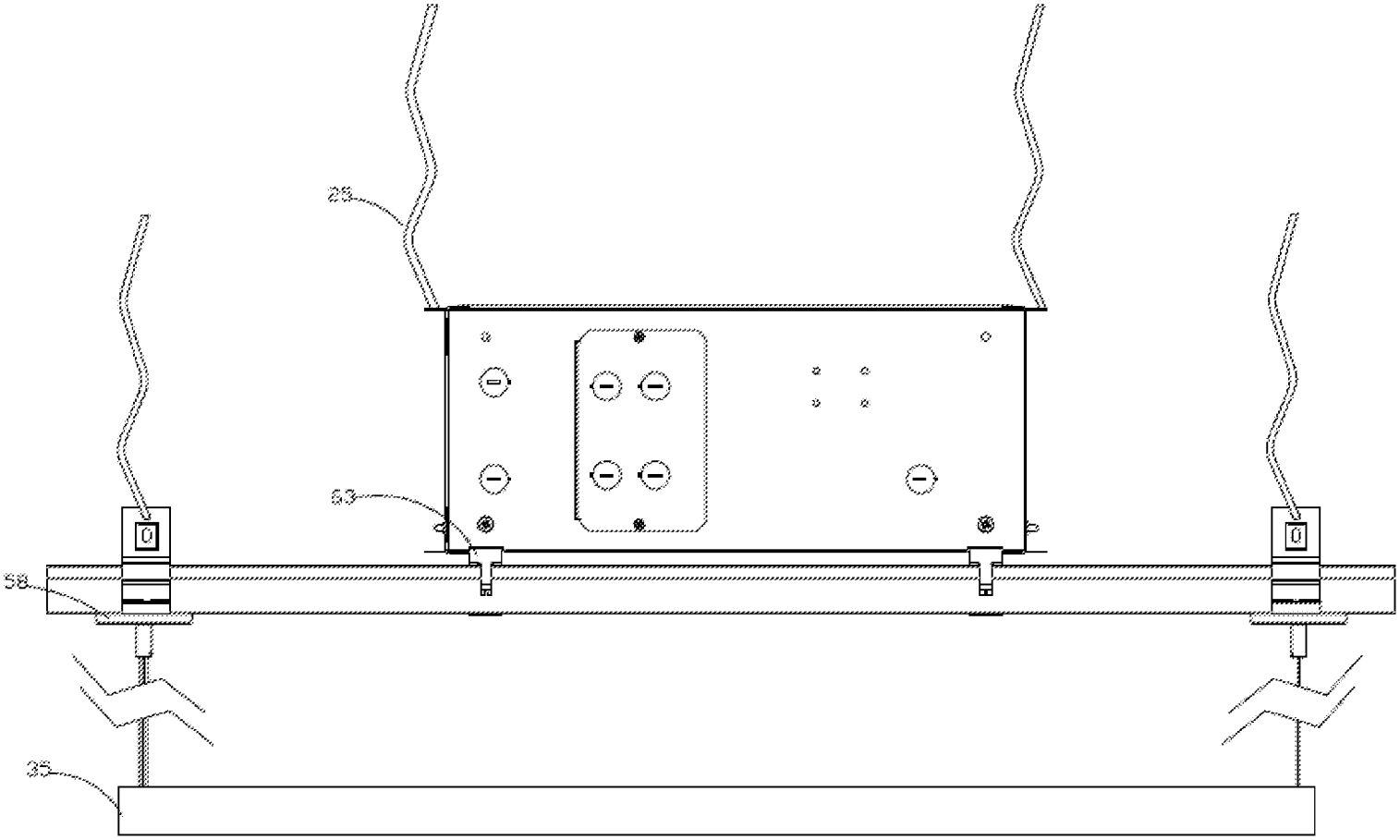

FIG. 46: Is a further detailed perspective of one mounting orientation of the grid driver box with the mounting hardware [63], tie back wire [25], and fixture [35] are detailed.

Figure 47:
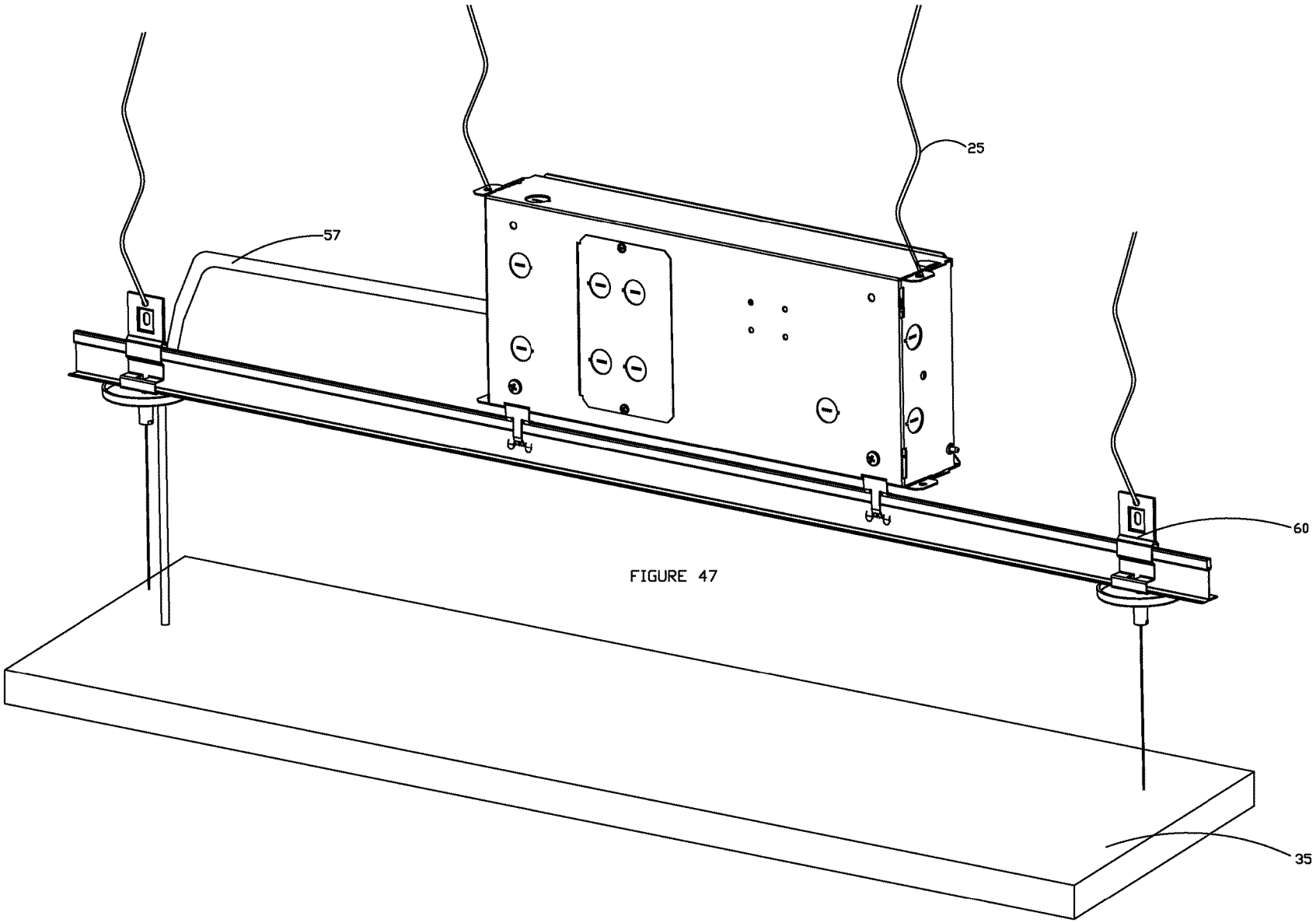

FIG. 47: Is a further detailed isometric perspective of one mounting orientation for the grid driver box with the mounting hardware [63], tie back wire [25], and fixture [35] are detailed.

DETAILED DESCRIPTION OF THE PREFERRED EMBODIMENTS

Figure 2:
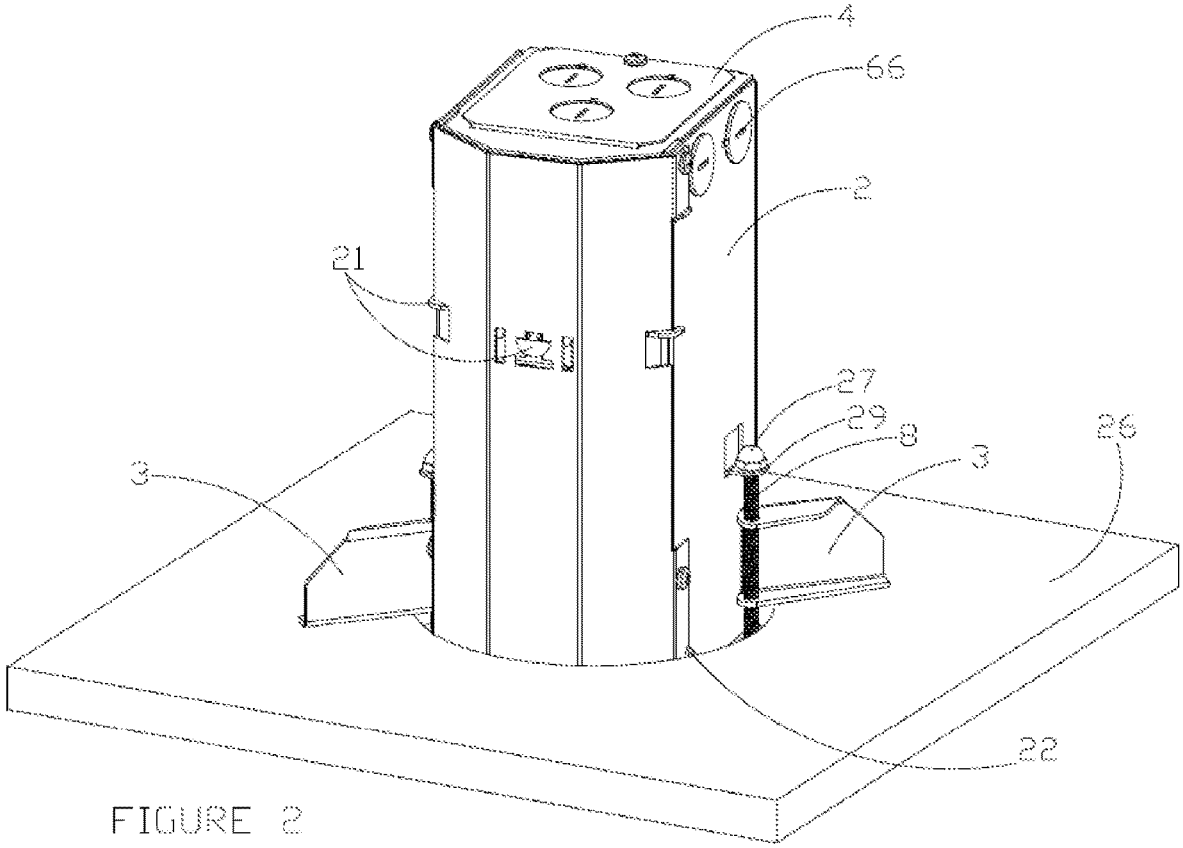
Figure 3:
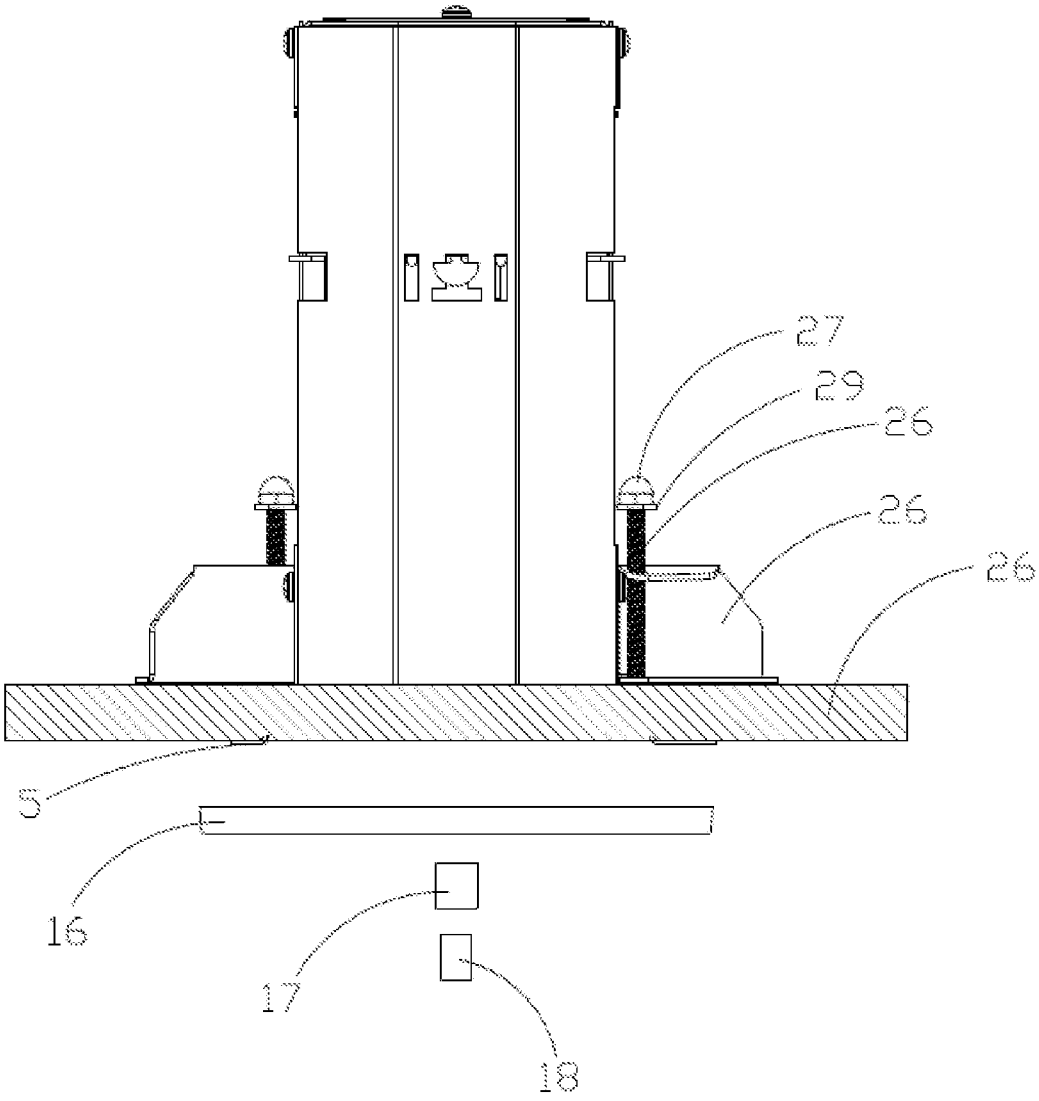

Referring now in more detail to the drawings, in which like numerals indicate like parts throughout the several views, FIG. 2 is a perspective of the Flange Driver box installation in a retro-fit or non-accessible ceiling application where the level lugs [3] are fully engaged to the ceiling, done by engaging the two bolts [8] until the level lugs are in tension with the ceiling. The level lugs provide the full support of the embodiment and its attached fixture. The installation procedure for this embodiment is described in more detail below.

Figure 8:
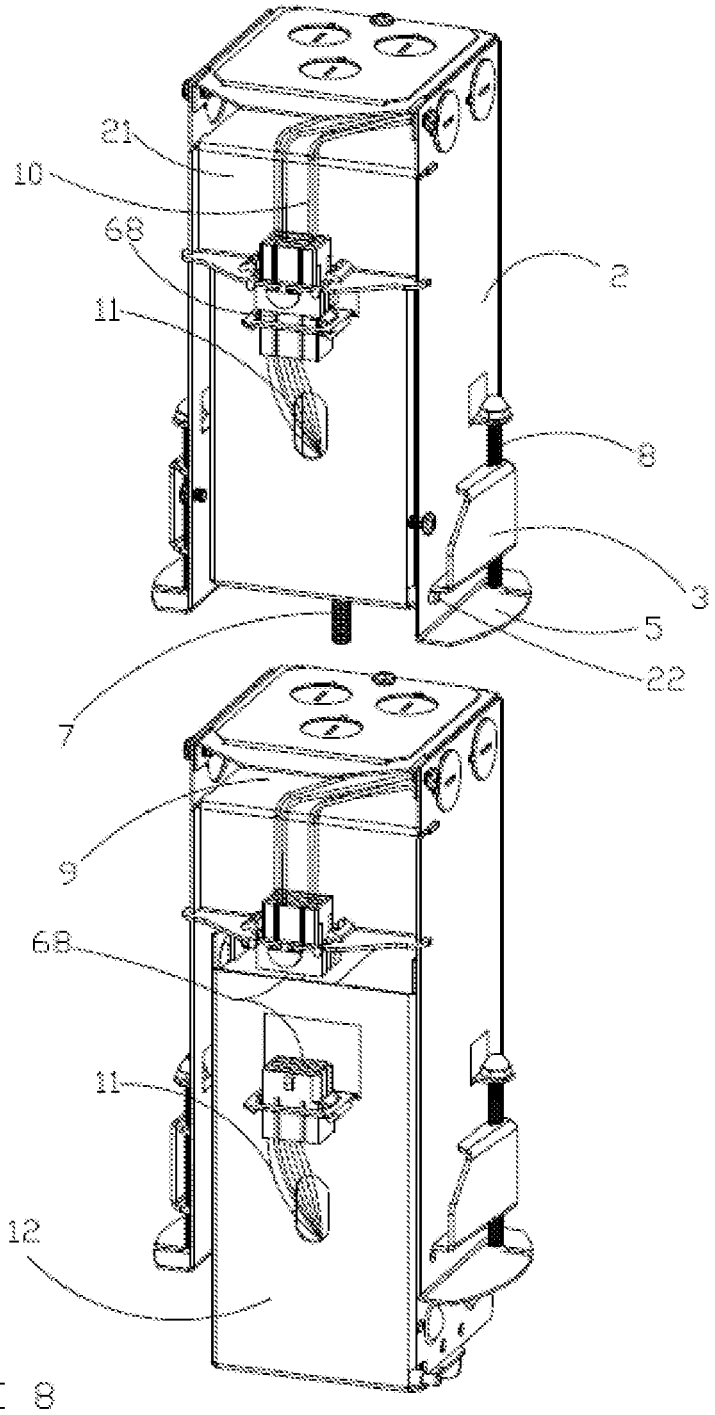
Figure 9:
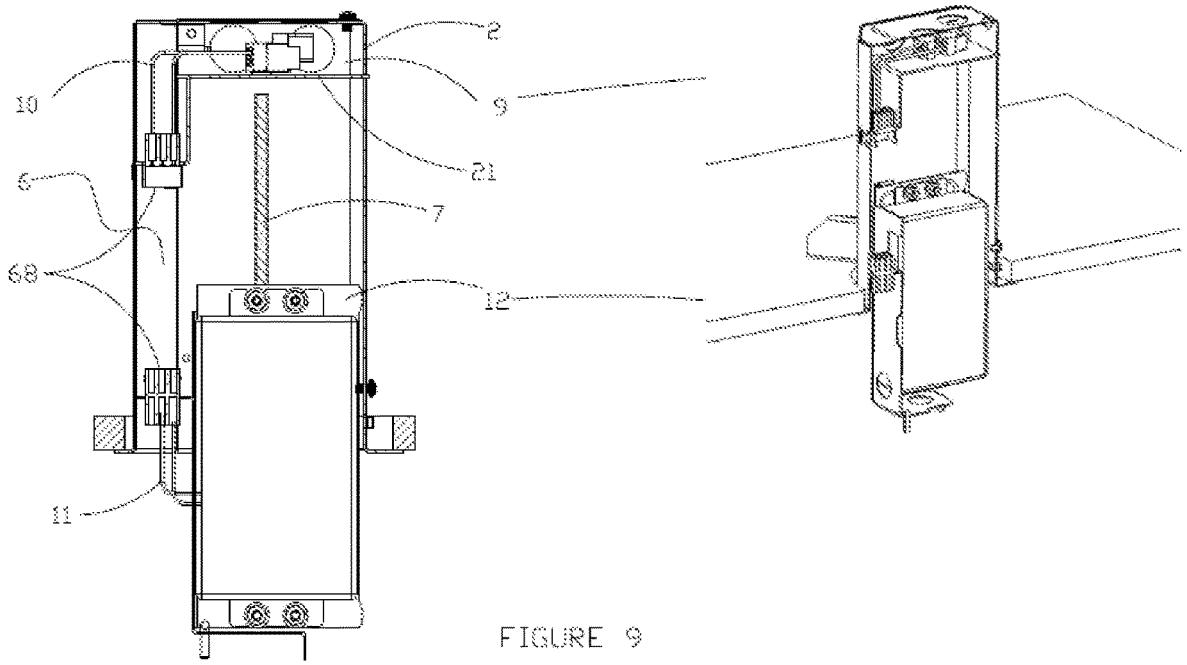

In this embodiment of the LED driver device, building power is first connected to the enclosure by conduit that extends from the access plate [4] or from any of the other knockouts in the upper compartment [9]. The conductors of the conduit are connected with the wires of the exit whip to pass electricity from the building to the LED components, where the building input is contained in an isolated compartment [9] that can be seen in further detail in FIG. 10. The exit whip [10] is fixed to a bracket component [21] that is installed and fixed to the embodiment housing and provides the separation of the driver tray [12] compartment and the junction box area for the contractor to make connections. FIGS. 8 and 9 provide an exploded view that gives further detail of the electrical engagement between the driver tray [12] and the exit whip compartment [9]. In this embodiment, when the driver tray [12] is disengaged from the exit whip bracket [9] the driver tray is the only moving component. This action of lowering the driver tray disengages the whip from the driver tray [11] and the whip from exit bracket [10]; this disconnects the electrical connection between the building power and the LED drivers [67] or the like. The driver tray may be accessed at any time during the installation or maintenance procedure. FIG. 9 shows a section view of the disengagement of the driver tray where the two compartments can be seen more explicitly [68]. In this embodiment, the exit whip compartment [9] is not accessible once the driver box is installed, providing added safety and removing the necessity for an electrician, and completely isolating the compartment from the low voltage compartment. Once the building power has been connected to the driver box, there is no longer a need to access the exit whip compartment [9]. In this embodiment, to insert the driver tray, you first compress the spring latch [22], and then continue to insert the driver tray into the housing until it no longer travels. This action is shown in detail in FIG. 8. The driver tray is fully inserted, and the electrical connection is made over the quick connect plugs, the latch is decompressed and released into a catch in the housing for safety and securement of the electronics.

The LED components such as LED drivers are fixed to the driver tray by hardware [33]. The spring latch [22] is fixed to the driver tray by rivets or other like hardware [31]. This is detailed in FIGS. 17 and 19.

The enclosure has an opening to the room, where the driver tray is inserted/removed from the housing. The canopy [16] that is installed over this opening, shown in FIG. 13, is composed of a flame rated V-0, 5VA material conforming to UL safety standards. When the embodiment is installed to the ceiling structure, the luminaire can then be installed. The mounting point is from a ¼-20" all thread rod, that is fixed to the wiring compartment divider bracket, shown in FIG. 12. FIG. 22 details the mounting assembly where the aircraft cable or fixture mounting cable [49] is inserted in the mounting coupler [18]. The mounting coupler has internal threads that are threaded onto the ¼-20" all thread. The aircraft cable [49] passes through the center hole of the canopy [16] and slip ring coupler [17]. The slip ring coupler has internal threads that thread onto the external threads of the fixture mount coupler [18]. When the slip ring coupler [17] is threaded to the mounting coupler, the canopy is also tightened to the ceiling interface. This is because the center hole in the canopy is larger than the mounting coupler, and smaller than the slip ring coupler. This action is detailed in FIG. 13.

The driver tray has a U shaped cut out [32] shown in FIG. 18. The U shape allows for the luminaire's mounting point to remain intact and the driver tray to be removed. By having a U shape instead of a single hole, the driver tray can maneuver around the mounting hardware. To remove the driver tray after the fixture is installed, the slip ring [17] and the canopy [16] are lowered to the fixture level. The spring latch is compressed, and the driver tray is pulled down, disconnecting the whips. The driver tray can then be maneuvered around the mounting point [7].

The driver tray has multiple features inherent to it that allow it to be aligned properly in the housing shown in FIG. 17. This alignment creates a key-like action, so the driver tray has only one orientation for install. The dimples [30] on the tray provide alignment in the x-axis. The extending material features [34] on the tray provide alignment in the z-axis. The whip connection and spring latch [22] engagement provide the alignment in the y-axis.

Figure 1:
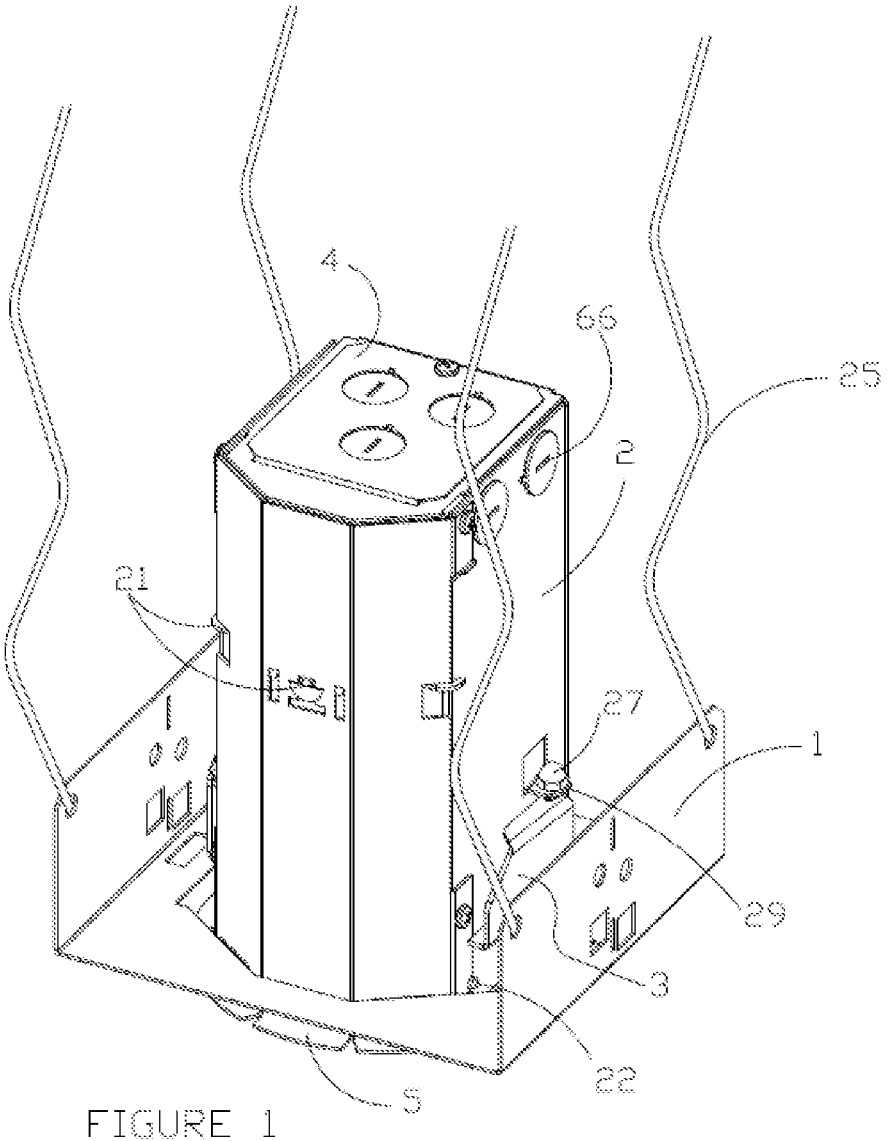
FIGS. 1-22 show one embodiment of the driver box, the Flange driver box (FRB).
Figure 4:
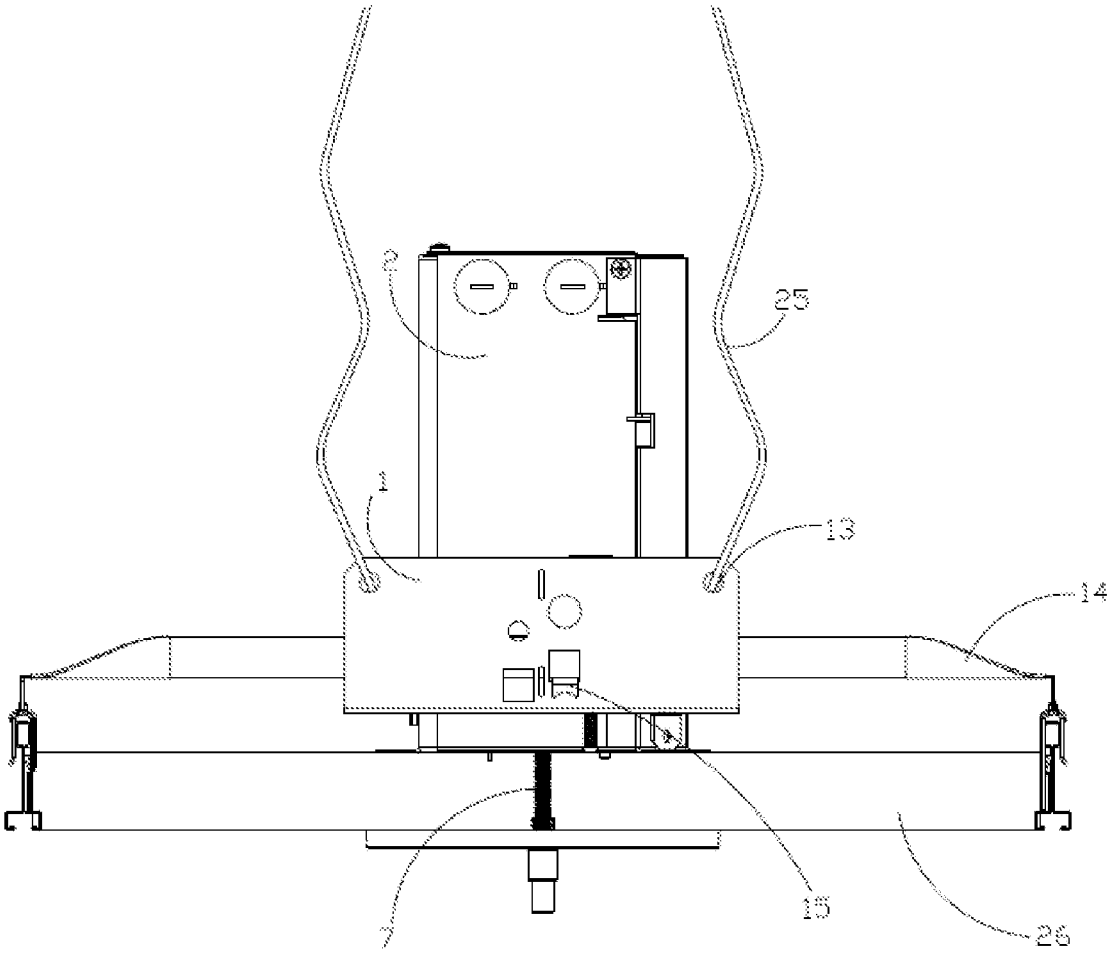
Figure 5:
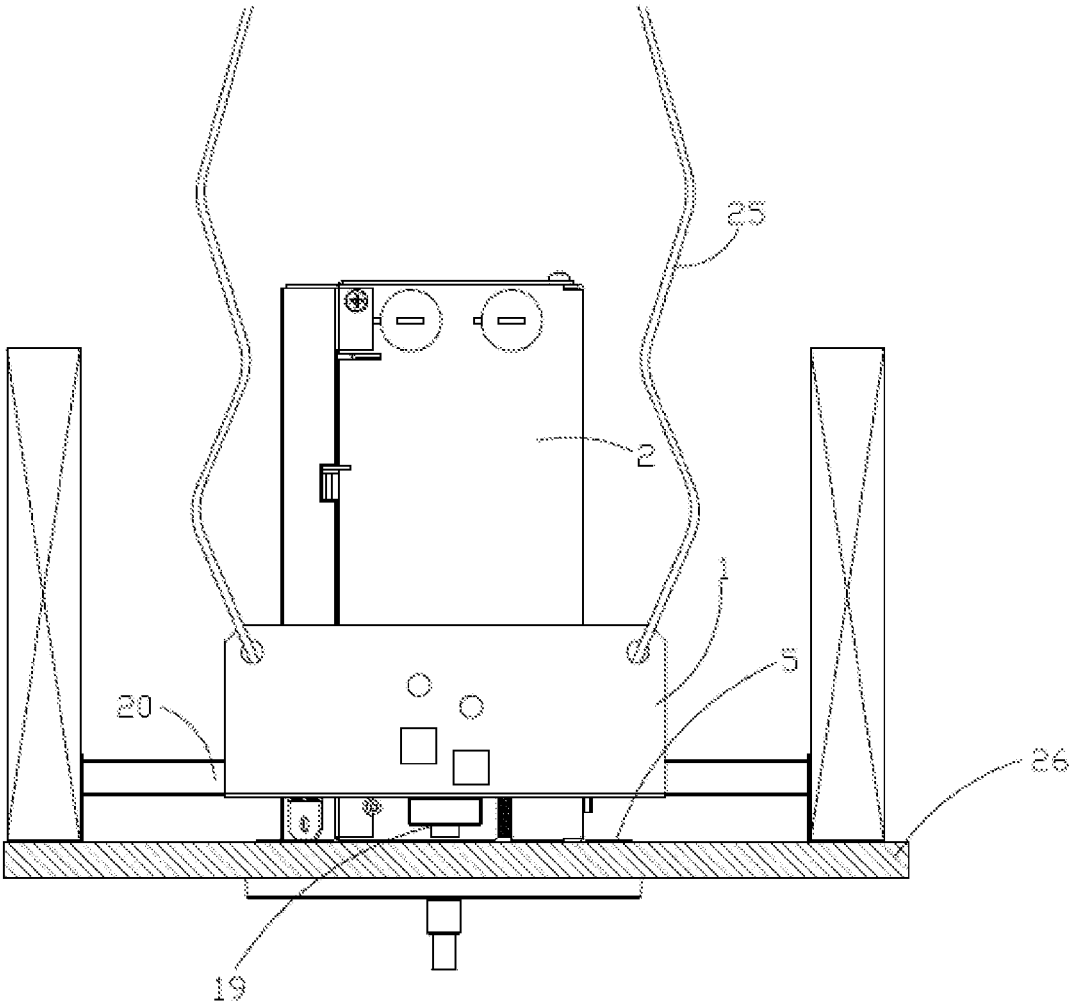

FIG. 1 provides a view of this embodiment where variations of the installations are required due to ceiling type, and the figure details a mounting bracket that is utilized for securing additional mounting hardware. FIG. 13 details how the mounting bracket is further secured to the ceiling structure by tie-back wire [25] through the tie-back wire holes on the bracket [13]. FIGS. 4 and 5 give further detailed views of how the various mounting hardware is attached to the mounting bracket and interfaced with the ceiling structures. FIGS. 20 and 21 give further detailed views of how the various mounting hanger bars [14 and 20] are secured to the mounting bracket. For variations of the embodiment that require a grid ceiling installation, FIG. 4 details the methods of installation of the hanger bars to the embodiment. Standard grid hanger bars [14] are used in FIG. 4 and are secured to the mounting bracket to the ceiling structure like T-Bar for example. The grid hanger bars [14] utilize their own hardware [15] to secure to the mounting bracket [2]. The joist hanger bars [20], detailed in FIG. 5, utilize their own mounting hardware [19] to secure to the mounting bracket. These are two examples of bars that can be mounting to the bracket.

Other embodiments of this remote driver enclosure can be seen in FIGS. 23-47.

There are multiple types of ceilings styles in the industry and to address all variations, multiple embodiments encapsulate these differentiations. This allows the LED driver boxes to be used by varying the embodiments so that they can be utilized for any ceiling type. For example, one embodiment is designed to work directly with T Grid ceiling types. This driver enclosure is shown in FIG. 34-47. An embodiment that is meant for structure ceiling types such as concrete or other like interfaces is shown in FIG. 23-33. These are both embodiment variations from the Flange Driver Box described at the beginning. In the following explained example, the embodiment is installed directly to the T-Grid by clips [63] and tie back wire [25], as shown in FIG. 45-47.

For some applications when the enclosure is installed in a grid ceiling, the person(s) installing it may want an enclosure that provides multiple mounting variations or are limited to what type of enclosure they can use due to pre-existing systems. There may be multiple points of interference in the plenum that create difficulty when trying to install the enclosures. For example, in the plenum there may be old piping, HVAC systems, or other like pre-existing systems. In one example of the embodiment, the enclosure has multiple orientations of installation which can be seen in FIG. 44. The ability to install the enclosure in different orientations allows the installer or person(s) to avoid elements in the ceiling plenum that would make it impossible or extremely difficult to install the enclosure.

The housing [2] is composed of 18GA galvanized steel, or other like material finish such as galvaneal, that doesn't require a secondary treatment process such as paint. The housing is a simple construction that requires no additional hardware. Formed and bent tabs [54] make a fully rigid housing enclosure shown in FIG. 38. There is a flange in the housing that serves as a panel mount bracket [47] for the whips to connect. This also serves as a separation between the HV and LV compartments of the enclosure, which is shown in further detail in FIG. 42. The driver tray whips [11] are connected to the contractor whips [10] and retained by the connectors specific captive style such as a locking ramp or MAT-N-LOK connection. In other embodiments there are brackets that cover and completely isolate the contractor wiring compartment [9] where the brackets need to be removed using tools to access the HV compartment.

This embodiment has multiple cut-outs in the housing to allow the hanging hardware to be installed in multiple locations. The embodiment requires two mounting clips [63] and two ¼-20" bolts [64] shown in FIG. 41, to be installed to the housing to provide the mounting locations for the enclosure. In this embodiment there are 3 different sets of mounting locations. These different sets of mounting locations are what offer the 3 different mounting orientations shown in FIG. 44. The hardware shown in FIG. 41 is a clip [63] compatible with all t-grid styles, that fits in the rectangular cut out, and also has a built-in nut so when the bolt [64] attaches the clip to the housing, all that is needed is to drive the bolt into the clip.

In this embodiment the fixture is not installed directly to the driver box. The fixture is installed to a remote ¼-20" bolt that is a method common in the lighting industry today. The mounting is detailed in FIG. 40. The ¼-20" hanging bolt [62] is inserted in the t-grid style clip [60], which is snapped to the specified T-grid style [61] and tied back to structure with tie-back wire [25] shown in FIG. 40. The canopy [58] for this application does not require a V0-5VA rating because it doesn't provide a barrier to the electrical components. The canopy is installed to the ceiling by being captured between the ceiling structure and the mounting coupler [59]. The fixture is mounted by aircraft cable [49] that is inserted into the mouthing coupler [59]. The low voltage fixture cable [57] is inserted through the strain relief feature [23] in the canopy and then fed into the driver box where it makes a wired connection via lever nuts in the contractor wiring compartment [9]. The compartment is accessible by opening the enclosure by the PEM hardware [50&53] or by removing the access plate [4]. There are various knockouts [66] on the access plate on the housing for the contractor to bring in the building conduit. In installation of the access plate and view of the contractor wiring compartment can be seen in further detail in FIG. 39.

Another embodiment of the driver tray [12] is composed of 16GA galvanized steel and contains the LED components such as LED drivers [67], battery packs and the like and detailed in FIGS. 36 and 37. In this embodiment the driver tray has louver features [51] to provided added ventilation to the ceiling space. There are two depressible PEM pins [52] on the driver tray that are engaged in the housing. The pins act as a pivot point for the driver tray, allowing the tray to swing open, while also being retained to the housing, for maintenance, trouble shooting, or making building connections. The driver tray in the open position can be seen in FIG. 35.

The tray is secured to the housing by a PEM interaction. The captive PEM screw [50] threads into the captive PEM nut [53] in the housing flange to close and secure the box. This PEM nut can be seen in further detail in FIG. 38.

When the enclosure is secured to the ceiling structure such as the Grid T-bar, the driver tray can be accesses before or after the fixture is installed like the other embodiments. An isometric view of the fully installed embodiment with the fixture secured to the mounting point can be seen in FIG. 45-47 offer other views of the fully installed enclosure.

In one embodiment the LED driver box can be mounted to a ceiling structure such as concrete or other like materials. An example of this embodiment can be found in FIGS. 23-33. In this example the LED components [67] are accessible and maintainable like in the other embodiments, where they are on a driver tray [12] or like system. In this example the tray is removable by a single screw at the rear of the housing, shown in FIG. 24. When the screw is loosened, and the tray is withdrawn from the housing shown in FIG. 24, the tray can be hung by the formed hook at the end of the tray shown in FIGS. 23 & 24. This hook can be inserted through the obround slot [46] in the housing shown in FIG. 28. The ease of hanging the tray to the housing allows the LED components [67] or like technology, to be in close proximity to the other wired connections and at the fixture's mounting location [37]. Having the components in close proximity reduces the losses in current that may occur when remoting technology over far distances. Additionally, it makes trouble-shooting issues that may occur easier on the contractor or person servicing the enclosure, because all items of potential failure are at one local point. In this embodiment, like the previous embodiment, has a similar means to disconnect power from the LED components. There is a quick connect plug [11] that may be dislodged to cut power from the building to the LED driver tray, as seen in FIG. 25. In this example of the embodiment the high and low voltage compartments are not isolated. In other embodiments, a bracket can be secured over the wire raceway [42] to provide full isolation from the high and low voltage compartments, shown in FIG. 27. If a shroud, or like means, were to cover the wire raceway once building power has been connected and established to the LED components, the high voltage compartment would be isolated from the person working in the enclosure. This would provide added safety and minimize the hazardous risk of electrical shock to the person working on the enclosure.

In this embodiment, the housing has multiple standard 4O junction box hole patterns [36] to allow the installation of the enclosure to a junction box. The enclosure may also be installed directly to the ceiling interface. There are dimples [41] on the back of the housing to allow play for uneven ceiling surfaces. This can be seen in further detail in FIG. 26.

As in all the other embodiments there is a bracket [47] that serves as a panel mount for the whips to connect with one another. The installation of this can be seen in FIGS. 23, 29 and 30. To disconnect the driver tray from the building input, the driver tray whip [11] needs to be disconnected from the contractor whip [10] by relieving the locking mechanism between the two connectors, described earlier in the document.

The fixture mounts to a bracket that is secured to the housing by hardware [42]. This bracket is not to be removed, and the details of how it is installed to the housing are shown in FIG. 28. The bracket has a PEM stand-off [37] that serves as the fixtures ¼-20" threaded mounting point. The bracket also includes an angled flange [45] that directs the LV fixture cable [57] into the proper LV compartment in the housing.

The fixed canopy is installed to the housing and fixture mounting bracket, providing a metal cover for the HV and LV wiring compartments. The installation of this bracket and the fixtures mounting hardware can be seen in detail in FIGS. 31 and 32.

The fixture is mounted to the enclosure by the PEM stand-off [37]. This installation is similar to the other embodiments where the aircraft cable is first inserted into the mounting coupler [18]. The mounting coupler is threaded onto the PEM stand-off. The slip ring [18] is then threaded to the mounting coupler. If the person servicing the enclosure needs to access the wiring compartment and keep the fixture installed, the person(s) would remove the slip ring [18] and the fixed canopy [38]. This component would be lowered to the fixture level, leaving the wiring compartment open and accessible while the fixture remains installed to the enclosure. The fully installed example of this embodiment can be seen in FIG. 33.

What is claimed is:

1. A LED driver device comprising:

a container with two compartments electrically isolated from each other for powering a hanging luminaire or LED system for installation in a new or retrofit application, one compartment bearing components to receive AC power and convey power to the second compartment and components for control signals, a second compartment bearing components to output DC power and control signals to a LED engine where the second compartment is a detachable tray or draw like sliding compartment bearing components selected from battery packs, LED drivers, sensor control units, or other remote electronics for DC power supply and control signals from the driver device, and, where the hanging luminaire is installed to the driver device by a fastener integral to the driver device housing by a mounting coupler and a mounting cable dropping through the mounting coupler so the detachable tray may be accessed with no interference to the hanging luminaire.

2. The LED device driver of claim 1 where the surface of the container bears hardware for attachment of the device to an architectural surface or structure selected from a flange, bracket, T-bars, grid hanger bars, hooks, cables, bolts, Nyloc nuts, captive PEM fasteners, screws, bars and springs.

3. The LED device driver of claim 2 where the detachable complimentary housing component has a complimentary shape to detach and attach from the second compartment selected from cylindrical, cubical and conical shapes for secure and facile engagement.

4. The LED device driver of claim 1, where the container with 2 compartments electrically isolated from each other, can be installed in multiple ceiling types including grid, drywall, or other like types.

5. The LED device driver of claim 1 where the wall separating the compartments of the driver is adjustable.

6. The LED device driver of claim 1 where the housing is different sizes to accommodate various sizes and dimensions of LED driving devices.

7. The LED device driver of claim 1 where fasteners such as screws, lugs, flanges and rods to secure it to a surface, rail, joist, cable, pole or like supporting means.

8. The LED device driver of claim 1 where both compartments bear detachable trays.

9. The LED device driver of claim 1 where the tray uses latches or like securing means to be securely attached.

10. The LED device driver of claim 1 where tray needs no fastener to be securely connected and function in the flange remote box.

* * * * *